US010746096B2

(12) United States Patent
Mokdad et al.

(10) Patent No.: US 10,746,096 B2
(45) Date of Patent: Aug. 18, 2020

(54) V-TYPE 4-STROKE INTERNAL COMBUSTION ENGINE WITH 20 CYLINDERS

(71) Applicant: LIEBHERR-COMPONENTS COLMAR SAS, Colmar (FR)

(72) Inventors: Béchir Mokdad, Jebsheim (FR); Christoph Henninger, Lausanne (CH)

(73) Assignee: LIBBHERR-COMPONENTS COLMAR SAS, Colmar (FR)

( * ) Notice: Subject to any disclaimer, the term of this patent is extended or adjusted under 35 U.S.C. 154(b) by 0 days.

(21) Appl. No.: 16/481,451

(22) PCT Filed: Jan. 19, 2018

(86) PCT No.: PCT/EP2018/051310
§ 371 (c)(1),
(2) Date: Jul. 26, 2019

(87) PCT Pub. No.: WO2018/138007
PCT Pub. Date: Aug. 2, 2018

(65) Prior Publication Data

US 2019/0353094 A1 Nov. 21, 2019

(30) Foreign Application Priority Data

Jan. 27, 2017 (DE) ..... 10 2017 000 747

(51) Int. Cl.
*F02B 75/22* (2006.01)
*F02B 75/02* (2006.01)
*F02B 75/18* (2006.01)

(52) U.S. Cl.
CPC ..... *F02B 75/222* (2013.01); *F02B 2075/027* (2013.01); *F02B 2075/1868* (2013.01)

(58) Field of Classification Search
CPC ..... F02B 2075/027; F02B 2075/1868; F02B 75/22; F02B 75/222
See application file for complete search history.

(56) References Cited

U.S. PATENT DOCUMENTS 1,752,713 A 4/1930 Whatley
1,776,760 A 9/1930 Barkeij
(Continued)

FOREIGN PATENT DOCUMENTS

DE 2615742 A1 * 10/1977 ..... F02M 55/02
DE 2615742 A1 10/1977
(Continued)

OTHER PUBLICATIONS

Wilson, W., "Practical Solution of Torsional Vibration Problems: With Examples from Marine, Electrical, and Automobile Engineering Practice," Available as Early as Jan. 1, 1935, Chapman & Hall, Ltd., London, England, 227 pages.
(Continued)

*Primary Examiner* — George C Jin
*Assistant Examiner* — Teuta B Holbrook
(74) *Attorney, Agent, or Firm* — McCoy Russell LLP

(57) ABSTRACT

A V-type 4-stroke internal combustion engine having 20 cylinders, having a counterclockwise or clockwise direction of rotation, comprising a crankshaft with a torsional vibration damper and a flywheel arranged on the crankshaft, wherein the crankshaft has crank throws forming a crank star, wherein in each case the piston rods of the two cylinders of a V-segment are connected to the same crank throw, wherein the crank throws C1 to C10 have one of the following angular sequences in the direction of rotation of the engine when seen from the side of the flywheel, with the crank throws numbered as C1 to C10 when starting from the side of the flywheel: (i) C1-C9-C4-C6-C3-C10-C2-C7-C5-
(Continued)

C8, (ii) C1-C8-C5-C7-C2-C10-C3-C6-C4-C9, (iii) C1-C9-C5-C7-C3-C10-C2-C6-C4-C8, (iv) C1-C9-C7-C3-C6-C10-C2-C4-C8-C5, (v) C1-C7-C5-C8-C2-C10-C4-C6-C3-C9, (vi) C1-C9-C7-C3-C5-C10-C2-C4-C8-C6, (vii) C1-C6-C8-C4-C2-C10-C5-C3-C7-C9, (viii) C1-C5-C8-C4-C2-C10-C6-C3-C7-C9, (ix) C1-C8-C4-C6-C2-C10-C3-C7-C5-C9.

19 Claims, 13 Drawing Sheets

(56) References Cited

U.S. PATENT DOCUMENTS

| | | | | |
|---|---|---|---|---|
| 2,034,368 | A | 3/1936 | Barkeij | |
| 2,740,389 | A | 4/1956 | Reyl | |
| 3,748,850 | A | 7/1973 | Von Hoevel et al. | |
| 3,978,828 | A | 9/1976 | Weber | |
| 5,826,563 | A | 10/1998 | Patel et al. | |
| 6,092,016 | A | 7/2000 | Sarangapani et al. | |
| 6,675,639 | B1 | 1/2004 | Schricker et al. | |
| 7,357,103 | B2 | 4/2008 | Koopmans | |
| 7,979,193 | B2 | 7/2011 | Harbert | |
| 10,082,074 | B2 | 9/2018 | Henninger et al. | |
| 10,260,421 | B2 | 4/2019 | Frese et al. | |
| 2003/0236609 | A1 | 12/2003 | Daniel et al. | |
| 2005/0235942 | A1 | 10/2005 | McCullagh | |
| 2009/0099755 | A1 | 4/2009 | Harbert | |
| 2011/0214642 | A1* | 9/2011 | Shafer | F02M 63/0285 123/456 |
| 2013/0006497 | A1 | 1/2013 | Silvers et al. | |
| 2015/0354471 | A1 | 12/2015 | Kopecek et al. | |
| 2017/0191410 | A1 | 7/2017 | Henninger | |

FOREIGN PATENT DOCUMENTS

| | | | | |
|---|---|---|---|---|
| DE | 102012214538 | A1 | 2/2014 | |
| DE | 102013213349 | A1 | 10/2014 | |
| DE | 102013113818 | A1 | 6/2015 | |
| EP | 1367238 | A1 | 12/2003 | |
| EP | 1548251 | A1 | 6/2005 | |
| EP | 1793104 | A1 | 6/2007 | |
| EP | 2952712 | A1 * | 12/2015 | F02D 41/0087 |
| EP | 2952712 | A1 | 12/2015 | |
| GB | 322161 | A | 11/1929 | |
| GB | 544804 | A | 4/1942 | |
| GB | 551406 | A | 2/1943 | |

OTHER PUBLICATIONS

Nestorides, E., "A Handbook on Torsional Vibration," Chapter 2, Part 2, Available as Early as Jan. 1, 1958, Cambridge at the University Press, London, England, 21 pages.

Ronnedal, P. et al., "Firing Order Selection in Relation to Vibration Aspects," Proceedings of the 2003 Spring Technical Conference of the ASME Internal Combustion Engine Division (ICES03), May 11, 2003, Salzburg, Austria, 11 pages.

Knorr, J. et al., "Firing Order Optimization Based on Integrated Simulation," Man Nutzfahrzeuge AG Powerpoint Presentation, Available Online at https://www.gtisoft.com/wp-content/uploads/publication/MAN2010.pdf, Oct. 25, 2010, 22 pages.

Buczek, K. et al., "Firing Order Optimization in FEV Virtual Engine," Proceedings of the 2014 Torsional Vibration Symposium, May 23, 2014, Salzburg, Austria, 8 pages.

Henninger, C., "Firing Sequence Optimization for a V20 Cylinder Diesel Engine," Proceedings of the 2014 Torsional Vibration Symposium, May 23, 2014, Salzburg, Austria, 8 pages.

Priestner, C. et al., "Crank Train Torsional Vibration Optimization," Proceedings of the 2014 Torsional Vibration Symposium, May 23, 2014, Salzburg, Austria, 8 pages.

Henninger, C., "Firing Sequence Optimisation on a V20," MTZ Industrial Special Edition, vol. 4, No. 2, Sep. 2014, Published Online Aug. 23, 2014, 6 pages.

Stadelmann, M. et al., "Generalized Torsional Vibration Analysis of Generating Sets for Diesel-Electric Powertrains," Proceedings of SIMPEP Kongress 2014, Sep. 17, 2014, Koblenz, Germany, 13 pages.

Henninger, C., "Four-Stroke Reciprocating Piston Engine in a V Configuration Having 20 Cylinders," U.S. Appl. No. 15/397,625, filed Jan. 3, 2017, 41 pages.

Henninger, C. et al., "Four-Stroke Reciprocating Piston Engine in a V Configuration Having 16 Cylinders," U.S. Appl. No. 15/397,654, filed Jan. 3, 2017, 39 pages.

ISA European Patent Office, International Search Report and Written Opinion Issued in Application No. PCT/EP2017/000878, dated Nov. 17, 2017, WIPO, 17 pages.

ISA European Patent Office, International Search Report Issued in Application No. PCT/EP2018/051310, dated Apr. 13, 2018, WIPO, 3 pages.

Mokdad, B., "V-Type 4-Stroke Internal Combustion Engine With 16 Cylinders," U.S. Appl. No. 16/319,071, filed Jan. 18, 2019, 30 pages.

* cited by examiner

| Crank star | Illustration |
|---|---|
| i) |  |
| ii) |  |
| iii) |  |

| | |
|---|---|
| iv) |  |
| v) |  |
| vi) |  |

| | |
|---|---|
| vii) |  |
| viii) |  |
| ix) |  |

| Crank star | Illustration |
|---|---|
| i) |  |
| ii) |  |
| iii) |  |

| | |
|---|---|
| iv) |  |
| v) |  |
| vi) |  |

| | |
|---|---|
| vii) |  |
| viii) |  |
| ix) |  |

V-TYPE 4-STROKE INTERNAL COMBUSTION ENGINE WITH 20 CYLINDERS

CROSS REFERENCE TO RELATED APPLICATIONS

The present application is a U.S. National Phase of International Patent Application Serial No. PCT/EP2018/051310 entitled "V-TYPE 4-STROKE INTERNAL COMBUSTION ENGINE WITH 20 CYLINDERS" filed on Jan. 19, 2018. International Patent Application Serial No. PCT/EP2018/051310 claims priority to German Patent Application No. 10 2017 000 747.0, filed on Jan. 27, 2017. The entire contents of each of the above-cited applications are hereby incorporated by reference for all purposes.

TECHNICAL FIELD

The selection of a suitable firing sequence and the appropriate orientation of the crank throws along the crankshaft axis, the so-called crank star, are of fundamental importance in the development of internal combustion engines, since these decisively determine the mechanical and thermodynamic characteristics of the engine. Torsional dynamics of the crankshaft depend particularly to a substantial extent on the firing sequence. In addition, further aspects have to be taken into account, such as the gas cycle dynamics, the load on the crankshaft bearings, as well as engine operating vibrations.

BACKGROUND AND SUMMARY

The number of possible firing sequences, or possible crank configurations, has already been largely described in the relevant literature for internal combustion engines with small number of cylinders, i.e. up to six cylinders for inline engines, and up to 12 cylinders for V-type engines. With increasing number of cylinders, the number of possible combinations of firing sequences or crank stars grows disproportionately, however, while the vibration dynamics of the crankshaft and of the entire engine become much more complex at the same time. Therefore, the selection of a suitable crank star and firing sequence for multi-cylinder internal combustion engines requires a deep understanding of both the mechanics and the vibration dynamics as well as of the gas cycle dynamics. The systematic evaluation therefore requires computer-assisted simulation and optimizing methods.

There exist already a couple of patents on firing sequences. U.S. Pat. No. 2,740,389 deals with the effects of firing sequences on the air path in internal combustion engines having a plurality of cylinders. U.S. Pat. No. 7,979,193 deals with the firing sequences of a 12 cylinder internal combustion engine in V90° configuration. EP 1 793 104 B9 shows a number of advantageous firing sequences for a 15-cylinder internal combustion engine in inline configuration.

It is the object of the present invention to provide a V-type 20 cylinder four-stroke internal combustion engine with advantageous properties regarding the above-mentioned criteria.

This object is achieved in a first aspect by a V-type 4-stroke internal combustion engine having 20 cylinders, having a counter-clockwise or clockwise direction of rotation, comprising a crankshaft, a torsional vibration damper and a flywheel arranged on the crankshaft, wherein the crankshaft has 10 crank throws forming a crank star, wherein in each case the piston rods of the two cylinders of a V-segment are connected to the same crank throw, wherein the crank throws C1 to C10 have one of the following angular sequences in the direction of rotation of the engine when seen from the side of the flywheel, with the crank throws numbered as C1 to C10 when starting from the side of the flywheel:

i) C1, C9, C4, C6, C3, C10, C2, C7, C5, C8
ii) C1, C8, C5, C7, C2, C10, C3, C6, C4, C9
iii) C1, C9, C5, C7, C3, C10, C2, C6, C4, C8
iv) C1, C9, C7, C3, C6, C10, C2, C4, C8, C5
v) C1, C7, C5, C8, C2, C10, C4, C6, C3, C9
vi) C1, C9, C7, C3, C5, C10, C2, C4, C8, C6
vii) C1, C6, C8, C4, C2, C10, C5, C3, C7, C9
viii) C1, C5, C8, C4, C2, C10, C6, C3, C7, C9
ix) C1, C8, C4, C6, C2, C10, C3, C7, C5, C9. Advantageous embodiments of the present invention form the subject of the dependent claims.

The first aspect of the present invention relates to the configuration of the crank star of the four-stroke internal combustion engine, i.e. to the arrangement of the crank throws along the crankshaft.

According to the first aspect, the present invention comprises a V-type 4-stroke internal combustion engine having 20 cylinders, having a counter-clockwise or clockwise direction of rotation, comprising a crankshaft, a torsional vibration damper and a flywheel arranged on the crankshaft, wherein the crankshaft has 10 crank throws forming a crank star, wherein in each case the piston rods of the two cylinders of a V-segment are connected to the same crank throw, wherein the crank throws C1 to C10 have one of the following angular sequences in the direction of rotation of the engine when seen from the side of the flywheel, with the crank throws numbered as C1 to C10 when starting from the side of the flywheel:

i) C1, C9, C4, C6, C3, C10, C2, C7, C5, C8
ii) C1, C8, C5, C7, C2, C10, C3, C6, C4, C9
iii) C1, C9, C5, C7, C3, C10, C2, C6, C4, C8
iv) C1, C9, C7, C3, C6, C10, C2, C4, C8, C5
v) C1, C7, C5, C8, C2, C10, C4, C6, C3, C9
vi) C1, C9, C7, C3, C5, C10, C2, C4, C8, C6
vii) C1, C6, C8, C4, C2, C10, C5, C3, C7, C9
viii) C1, C5, C8, C4, C2, C10, C6, C3, C7, C9
ix) C1, C8, C4, C6, C2, C10, C3, C7, C5, C9.

Four-stroke internal combustion engines in a V configuration having 20 cylinders having such crank stars are not known from the prior art. The inventors of the present invention have taken into account that the design of the crank star and in particular the order of the individual crank throws along the crankshaft also have a substantial influence on the vibration dynamics of the crankshaft and of the engine. The inventors have determined, on the basis of a computer-assisted simulation and optimizing method and by a systematic evaluation of the mechanics and vibration dynamics relevant to the selection of a suitable crank star, those crank stars which have particularly good properties with respect to the vibration properties.

Independently of the configuration of the crank star of the four-stroke internal combustion engine according to the first aspect, i.e. to the arrangement of the crank throws along the crankshaft, the present invention relates in a second aspect to the firing sequences of a V-type 20 cylinder four-stroke internal combustion engine.

In the second aspect, the present invention deals with optimized firing sequences for a V-type 20 cylinder four-stroke internal combustion engine. Since the optimum firing sequences depend on the direction of rotation of the four-stroke internal combustion engine, this first aspect comprises two variations.

In a first variant of the second aspect, the present invention comprises a V-type 4-stroke internal combustion engine with 20 cylinders, having a counter-clockwise direction of rotation, comprising a firing sequence controller that fires the cylinders A1 to A10 and B1 to B10 in at least one of the following firing sequences, wherein the direction of rotation and the cylinder numbering is defined in accordance with DIN ISO 1204:

a) A1-A5-B2-A4-B6-B3-A6-B9-B1-A9-B8-B4-A8-B10-A2-A10-B7-A3-A7-B5 b) A1-B4-B2-A4-B6-B3-A6-B9-B1-A9-B8-A5-A8-B10-A2-A10-B7-A3-A7-B5 c) A1-A6-B2-A4-B5-B3-A5-B9-B1-A9-B8-B4-A8-B10-A2-A10-B7-A3-A7-B6 d) A1-B4-B2-A4-B5-B3-A5-B9-B1-A9-B8-A6-A8-B10-A2-A10-B7-A3-A7-B6 e) A1-A9-B5-A3-A5-B4-A2-A4-B1-A6-B7-B3-A7-B10-B2-A10-B8-B6-A8-B9 f) A1-A9-B6-A3-A6-B4-A2-A4-B1-A5-B7-B3-A7-B10-B2-A10-B8-B5-A8-B9 g) A1-A8-B2-A6-B3-A10-B5-A7-B1-A9-B4-B6-A4-B10-A2-B7-A3-B9-A5-B8 h) A1-A8-B2-A7-B3-A10-B4-A6-B1-A9-B5-B7-A5-B10-A2-B6-A3-B9-A4-B8 i) A1-B6-A4-B10-A3-B7-A2-B8-B1-A8-B4-A9-B3-A6-B2-A10-B5-A7-A5-B9 j) A1-B6-A3-B10-A4-B8-A2-A8-B1-A7-B3-A9-B4-A6-B2-A10-B5-B7-A5-B9 k) A1-B7-A5-B10-A3-B6-A2-B8-B1-A8-B5-A9-B3-A7-B2-A10-B4-A6-A4-B9 l) A1-A6-B2-B10-A2-A10-B7-B9-A7-A9-B8-B4-A8-A4-B5-B3-A5-A3-B1-B6 m) A1-A5-B2-B10-A2-A10-B7-B9-A7-A9-B8-B4-A8-A4-B6-B3-A6-A3-B1-B5

In a second variant of the second aspect, the present invention comprises a V-type 4-stroke internal combustion engine with 20 cylinders, having a clockwise direction of rotation, comprising a firing sequence controller that fires the cylinders A1 to A10 and B1 to B10 in at least one of the following firing sequences, wherein the direction of rotation and the cylinder numbering is defined in accordance with DIN ISO 1204:

B1-B5-A2-B4-A6-A3-B6-A9-A1-B9-A8-A4-B8-A10-B2-B10-A7-B3-B7-A5

B1-A4-A2-B4-A6-A3-B6-A9-A1-B9-A8-B5-B8-A10-B2-B10-A7-B3-B7-A5

B1-B6-A2-B4-A5-A3-B5-A9-A1-B9-A8-A4-B8-A10-B2-B10-A7-B3-B7-A6

B1-A4-A2-B4-A5-A3-B5-A9-A1-B9-A8-B6-B8-A10-B2-B10-A7-B3-B7-A6

B1-B9-A5-B3-B5-A4-B2-B4-A1-B6-A7-A3-B7-A10-A2-B10-A8-A6-B8-A9

B1-B9-A6-B3-B6-A4-B2-B4-A1-B5-A7-A3-B7-A10-A2-B10-A8-A5-B8-A9

B1-B8-A2-B6-A3-B10-A5-B7-A1-B9-A4-A6-B4-A10-B2-A7-B3-A9-B5-A8

B1-B8-A2-B7-A3-B10-A4-B6-A1-B9-A5-A7-B5-A10-B2-A6-B3-A9-B4-A8

B1-A6-B4-A10-B3-A7-B2-A8-A1-B8-A4-B9-A3-B6-A2-B10-A5-B7-B5-A9

B1-A6-B3-A10-B4-A8-B2-B8-A1-B7-A3-B9-A4-B6-A2-B10-A5-A7-B5-A9

B1-A7-B5-A10-B3-A6-B2-A8-A1-B8-A5-B9-A3-B7-A2-B10-A4-B6-B4-A9

B1-B6-A2-A10-B2-B10-A7-A9-B7-B9-A8-A4-B8-B4-A5-A3-B5-B3-A1-A6

B1-B5-A2-A10-B2-B10-A7-A9-B7-B9-A8-A4-B8-B4-A6-A3-B6-B3-A1-A5

The inventors of the present invention have arrived at these firing sequences on the basis of a computer-assisted simulation and optimization procedure, including a systematic evaluation of structural vibrations and gas cycle dynamics relevant to the selection of a suitable firing sequence for V20 internal combustion engines. The claimed firing sequences have particularly advantageous properties with respect to torsional vibrations of the crankshaft, gas cycle dynamics, load on the crankshaft main bearings and engine operational vibrations.

The fatigue strength and thus the service life of the engine are increased by the reduced load on the crankshaft and on the crankshaft bearings as well as by the reduction of engine operational vibrations. The construction effort for the engine and for the connection to further components can furthermore be reduced. In possible applications, due to the small torsion load on the crankshaft due to the optimized firing sequences, inexpensive crankshaft materials may be used. The reduction in the torsional vibrations can furthermore permit the use of a compact torsional vibration damper of a simple design. These aspects represent a substantial cost advantage in mass production.

In the four-stroke internal combustion engines in a V configuration having 20 cylinders of the second aspect of the present invention, the crankshaft has crank throws at which the connecting rods of the cylinders engage. Preferably, the connecting rods of the two cylinders of a V-segment of the four-stroke internal combustion engine share a common crank. The crank throws of the crankshaft, in their orientation along the crankshaft axis, form a so-called crank star.

The optimized firing sequences in accordance with the second aspect and the optimized crank stars in accordance with the first aspect form independently from each other the subject matter of the present invention.

However, in a preferred embodiment, the first and the second aspect are combined. In particular, the four-stroke internal combustion engines of the present invention are preferably operated with a crank star configured in accordance with the first aspect and with a firing sequence in accordance with the second aspect.

The following combinations of the crank stars and firing sequences discussed above are particularly preferred, both for V-type 4-stroke internal combustion engine having a clockwise and counter-clockwise direction of rotation:

crank star i), firing sequence h
crank star ii), firing sequence i
crank star iii), firing sequence g
crank star iv), one of the firing sequences a, b and m
crank star v), firing sequence j
crank star vi), one of the firing sequences c, d and l
crank star vii), firing sequence e
crank star viii), firing sequence f
crank star ix), firing sequence k The inventors of the present invention have recognized that particularly good results can be achieved by these combinations of the crank star and firing sequence.

Preferred embodiments of the present invention, which can be used both with a four-stroke internal combustion engine in accordance with the first aspect, and with a four-stroke internal combustion engine in accordance with the second aspect, and with a combination of these aspects, will be explained in more detail in the following.

In embodiments of the present invention, the V angle of the four-stroke internal combustion engine can be chosen to be between 40° and 80°, more preferably between 50° and 70°, more preferably between 55° and 65°, most preferably at 60°. The inventors of the present invention have recognized that the V angle also has an influence on the above-named aspects to be optimized. There is furthermore a certain interaction between the firing sequences or crank stars and the V angle. In the present embodiment, the V angle is not optimized with respect to the firing behavior of the 20 cylinder engine, as it does not allow equidistant firing sequences. However, the V-angle is chosen such that it can be used for a whole range of engines having different numbers of cylinders, in order to keep production costs low.

The crankshaft has 10 crank throws at which the connecting rods of the cylinders engage, with the connecting rods of the two cylinders of a V-segment of the four-stroke internal combustion engine each sharing a common crank throw. The crank throws form a crank star.

In a preferred embodiment, a simple crank star is used for the engines of the present invention, i.e. a crank star where all the crank throws have a different angular position. This is contrary to conventional engine design, which makes use of a symmetric crankshaft formed by two symmetric halves. While such symmetric crankshafts have advantages with respect to free moments of accelerated masses, the inventors of the present invention have found that a simple or asymmetric crank star will be more advantageous if all aspects of the optimization are taken into account.

In a preferred embodiment, the crank throws are arranged on the crank star with an intermediate angle of n*36°±5°, preferably of n*36°±3°, more preferably of n*36°±1°, wherein n is a different integer between 1 and 9 for each crank star. The crank throws are therefore arranged equidistantly or at least quasi-equidistantly on the crankshaft.

The present invention preferably uses firing sequences where the angular distances between to firings are not too far away from each other. This is easier to accomplish with an asymmetric crank shaft, which therefore allows to improve the regularity of the firing intervals.

In a preferred embodiment, the firing sequences have an angular firing distance for two cylinders of the same bank between 26° and 46°, preferably between 31° and 41°, most preferably at 36°. The firing sequences have, for the counter-clockwise direction of rotation, an angular firing distance for a firing of a cylinder of the A-bank followed by a firing of a cylinder of the B-bank of between 38° and 58°, preferably between 43° and 53°, most preferably at 48° and/or for a firing of a cylinder of the B-bank followed by a firing of a cylinder of the A-bank of between 14° and 34°, preferably between 19° and 29°, most preferably at 24°.

For the clockwise direction of rotation, the firing sequences preferably have an angular firing distance for a firing of a cylinder of the B-bank followed by a firing of a cylinder of the A-bank of between 38° and 58°, preferably between 43° and 53°, most preferably at 48°, and/or for a firing of a cylinder of the A-bank followed by a firing of a cylinder of the B-bank of between 14° and 34°, preferably between 19° and 29°, most preferably at 24°.

The four-stroke internal combustion engine in accordance with the invention preferably has a torsional vibration damper which damps the torsional vibrations of the crankshaft. Because an engine according to the present invention will have lower torsional vibrations, the required power loss of the torsional vibration damper can equally be reduced with respect to known four-stroke internal combustion engines.

The power loss of the torsional vibration damper preferably amounts to less than 3 per mil of the maximum engine power; further preferably to less than 2 per mil; further preferably to less than 1.5 per mil; and further preferably to less than 1 per mil of the maximum engine power. It is additionally possible due to the required power loss of the torsional vibration damper reduced in accordance with the invention to use favorable and technically less complex vibration dampers.

Due to the reduction of the power loss of the torsional vibration damper, the present invention makes it possible to use technically less complex vibration dampers.

In accordance with an aspect of the invention, a viscous damper is used. Such a damper is substantially less expensive than a leaf spring damper. The use of a leaf spring damper remains of course possible for engines of the present invention depending on the application purpose.

The four-stroke internal combustion engine in accordance with the invention has a crankshaft and a flywheel arranged on the crankshaft. The power take-off preferably takes place at the side of the flywheel, which is typically connected directly or via a coupling to a shaft which drives a load. The torsional vibration damper is preferably arranged at the free side of the crankshaft disposed opposite the flywheel. The torsional vibration damper is particularly preferably arranged outside the engine casing.

Four-stroke internal combustion engines in accordance with the present invention can be used in a plurality of different configurations and dimensions.

In a possible embodiment of the present invention, the displacement volume per cylinder is between 1 l and 20 l, preferably between 1.5 l and 15 l, more preferably between 2 l and 9 l.

In a possible embodiment of the present invention, the maximum engine power per liter displacement volume is between 10 kW and 100 kW, preferably between 20 kW and 70 kW.

In a possible embodiment of the present invention, the engine has an operating speed range of between 600 and 2100 rpm. The speed range of a specific four-stroke internal combustion engine in accordance with the invention actually used for an application can make up a part range of this speed range.

In a possible embodiment of the present invention, the engine has an engine controller programmed to run the engine at a constant nominal operating speed, wherein the constant nominal operating speed preferably can be adapted based on engine conditions and/or load conditions, and/or wherein the constant nominal operating speed preferably is from an operating speed range between 600 and 2100 rpm.

In particular, the engine is preferably controlled such that the engine again reaches the nominal engine speed after brief load changes which allow the actual engine speed to deviate from the nominal engine speed. In a possible embodiment, the nominal engine speed can be kept constant. The nominal engine speed is in particular kept constant over time periods which are long with respect to the typical load changes. In accordance with the invention, the engine control can, however, be designed such that the nominal engine speed can be adapted to changing engine conditions and/or load conditions.

The engine in accordance with the invention can, however, also be operated using any desired other engine control principles.

In possible embodiments of the present invention, the engine is operable with a gaseous and/or with a liquid fuel, wherein the engine can preferably be operated with at least one of the following fuels: gas, diesel, gasoline.

The engine in accordance with the invention can be a gas engine. In this case, the engine is operable with a gaseous fuel such as hydrogen, natural gas, biogas and/or liquefied gas.

Alternatively or additionally, the engine can also be operable with a liquid fuel. The engine can, for example, be operable with diesel and/or gasoline.

In a possible embodiment, the engine in accordance with the invention can only be operable only with a gaseous fuel or only with a liquid fuel. Alternatively, an operation with both a gaseous fuel and with a liquid fuel is possible.

In possible embodiments of the present invention, the engine has a direct injection system and/or a high pressure injection system. Such injection systems are particularly preferably used with an engine which is operable with liquid fuel.

In possible embodiments of the present invention, the engine can be operated with a Diesel or an Otto combustion process.

In possible embodiments of the present invention, the engine controller is programmed to operate the engine with a homogeneous charge and/or stratified charge combustion method. In possible applications, one out of several available combustion methods can be used in dependence on the engine conditions and/or load conditions.

In a possible embodiment of the present invention, the engine is a suction engine. Alternatively, the engine may be equipped with a boosting system with one or several stages. The engine can in particular have one or more turbochargers and/or compressors.

In a preferred embodiment of the present invention, all cylinders of one cylinder bank have a common intake manifold and/or a common exhaust manifold, wherein the exhaust manifolds are preferably arranged with respect to the V-angle on the inside and the intake manifolds are arranged with respect to the V-angle on the outside.

The engine of the present invention can be used in a multitude of different applications:

In a possible application, the engine is used as a power unit in a heavy duty and/or mining and/or earth moving and/or transport and/or cargo and/or load handling machine, preferably for an excavator and/or a dumper truck.

In a possible application, the engine is used to run a generator and/or a hydraulic pump, the generator and/or the hydraulic pump preferably operating one or more drives of an undercarriage and/or working equipment, preferably of a heavy duty and/or mining and/or earth moving and/or transport and/or cargo and/or load handling machine, preferably for an excavator and/or an dumper truck.

In a possible application, the engine is coupled directly or via a mechanical gear train to an undercarriage and/or working equipment, preferably of a heavy duty and/or mining and/or earth moving and/or transport and/or cargo and/or load handling machine, preferably for an excavator and/or a dumper truck.

In a possible application, the engine is used as the main power unit for a ship. In this case, the crankshaft preferably drives the propeller of the ship. The shaft of the propeller can be connected to the flywheel of the engine directly or via a clutch and/or a transmission.

In a possible application, the engine is used as the main power unit for a train. In this case, the engine preferably drives a generator. The rail vehicle can in particular be operated diesel electrically. Alternatively, the drive can take place via a transmission which is preferably connected to the engine by means of a clutch and/or a torque converter.

In a possible application, the engine is used as a power unit in military equipment. The engine can in particular be used in an armored vehicle and/or in a rocket carrier and/or in a speedboat and/or in a submarine.

The engine in accordance with the invention can furthermore be used as a drive for fluid transport and/or for gas and/or fuel production and/or treatment. For example, the engine can be used as the drive of a pump and/or of an oil and/or gas extraction machine, of an oil and/or gas transporting machine and/or of an oil and/or gas processing machine.

In a possible application, the engine is used as a power unit for power generation, an in particular drives a generator. The engine can be used for stationary or mobile power generation.

In a possible application, the engine is used as a power unit for a mobile and/or stationary machine.

In a possible application, the load can be connected to the crankshaft in a torsionally rigid manner. Alternatively, the load can, however, also be connected to the crankshaft via a torsionally flexible coupling. Such a torsionally flexible coupling absorbs torsional vibrations to a certain extent and thus reduces the transmission of still present torsional vibrations of the crankshaft to the driven load.

The present invention further comprises a machine comprising a V-type 4-stroke internal combustion engine as described above. The engine of the present invention may in particular be used to drive the machine or a piece of working equipment of the machine.

In particular, the machine may be a stationary or a mobile machine.

The machine in accordance with the invention is in particular one of the above-named applications. The machine in accordance with the invention can, for example, be a heavy duty and/or mining and/or earth moving and/or transport and/or cargo and/or load handling machine, and/or a ship and/or a train and/or a military and/or fluid transport and/or gas and/or oil production and/or treatment machine and/or a power generator. Preferably, the machine is an excavator and/or a dumper truck.

The present invention further comprises a firing sequence controller or a software for a V-type 4-stroke internal combustion engine with 20 cylinders, in particular for a V-type 4-stroke internal combustion engine as described above, the firing sequence controller or software implementing at least one of the firing sequences provided above with respect to the second aspect. In the firing sequence controller of the present invention, the firing sequence may be predefined by the constructional design of the engine, for example by a firing sequence controller driven mechanically via a camshaft. Preferably, the firing sequence controller comprises an electronic controller programmed to control the engine with one of the inventive firing sequences.

The present invention further comprises a method for operating a V-type 4-stroke internal combustion engine with 20 cylinders, in particular a V-type 4-stroke internal combustion engine as described above, wherein the engine is operated with at least one out of the firing sequences provided above with respect to the second aspect.

BRIEF DESCRIPTION OF THE FIGURES

The present invention will now be presented in more detail with reference to embodiments and to drawings.

The figures show.

Figure 1:
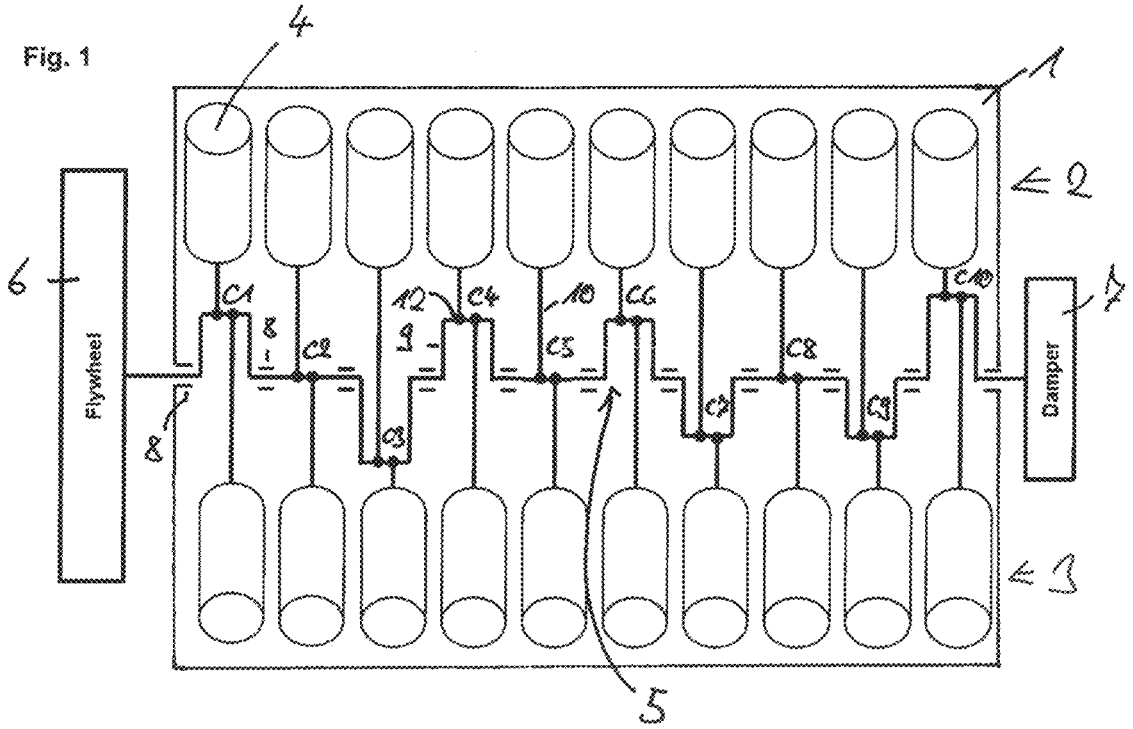
FIG. 1: a 20V-engine driveline scheme.
Figure 2:
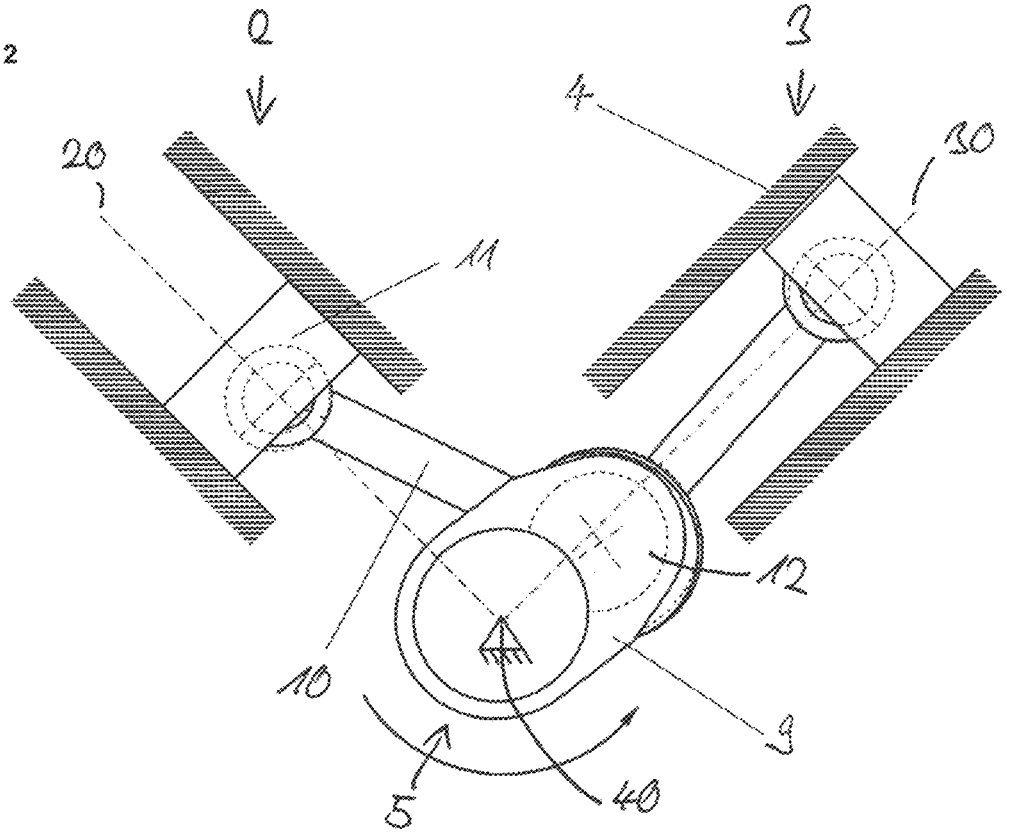
FIG. 2: an embodiment of a V-engine architecture.
Figure 3:
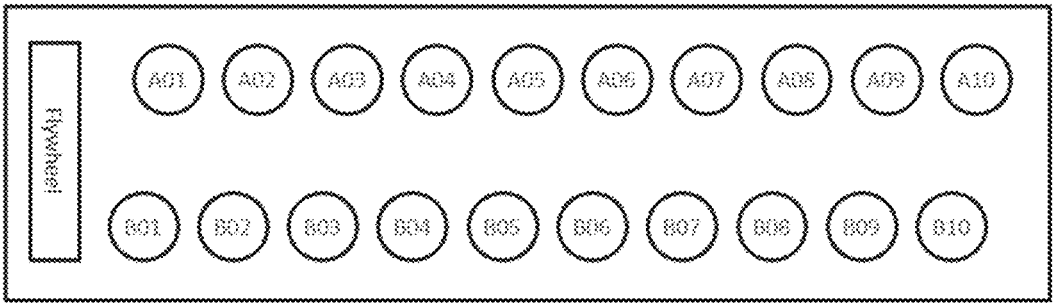
FIG. 3: a schematic drawing showing a 20 cylinder V-type engine and the cylinder numbering according to ISO 1204 used herein.

The design of a four-stroke reciprocating internal combustion engine having 20 cylinders in accordance with the invention is shown schematically in FIGS. 1 to 3.

DETAILED DESCRIPTION

FIG. 1 schematically shows the casing 1 of the engine in which the cylinders 4 of the engine are arranged. The crankshaft 5 driven by the cylinders is supported via bearings 8. In accordance with the V-configuration, the cylinders 4 of the engine are arranged in two lines, the so-called cylinder banks 2 and 3.

All cylinders are aligned in parallel with one another within the respective cylinder banks 2 and 3. As can be seen from FIG. 2, the main axes 20 of the cylinders of the first cylinder bank 2 and the main axes 30 of the cylinders of the second cylinder bank 3 enclose a V-angle $\alpha$. In the schematic diagram shown in FIG. 2, the center 40 of the crankshaft 5 extends at the point of intersection of the main axes 20 and 30. Alternatively, the center 40 has a lateral offset with respect to the plane of symmetry.

The crankshaft has crank throws 9 which form a crank star. The crank throws 9 each have crank pins 12 at which the connecting rods of at least one cylinder engages. It is the task of the individual crank throws to convert the force applied to the pistons by the gas pressure into a torque, which is transmitted as the effective torque via the crankshaft and the flywheel 6 to the power take-off. In modern V-engines, the crank throws of a V-segment typically act on the same crank pin. In the embodiment, the connecting rods 10 of oppositely disposed cylinders, i.e. the connecting rods of a V-segment of the V-engine, therefore each engage at a common crank throw or at the crank pin of a common crank throw. The crank pin of a crank throw can also be split into two to achieve a certain angular offset.

The crankshaft is supported via bearings 8 at the crank case between all V-segments. The respective crank pins 12 are arranged eccentrically to the axis of rotation 40 of the crankshaft due to the crank throws 9 so that the linear motion of the pistons 11 in the cylinders 4 is converted into a rotational movement of the crankshaft 5.

As shown in FIG. 1, the flywheel 6 is arranged at the one end of the crankshaft; a torsional vibration damper 7 is typically arranged at the other free end. The torsional vibration damper 7 can be a rubber damper or a leaf spring damper in a possible embodiment. A viscous oil torsional vibration damper is, however, preferred.

The torsional vibration damper 7 is arranged outside the crank case 1 in the embodiment. This is the preferred arrangement if a viscous oil torsional vibration damper is used. The damper can hereby be cooled by the environmental air. An arrangement of the damper within the casing of the engine is likewise conceivable, in particular when the damper is to be cooled via the engine lubricant. The flywheel 6 is likewise arranged outside the casing 1.

The engine's power take-off is typically carried out at the flywheel 6. For this purpose, the flywheel is connected via a coupling to a shaft, which drives the corresponding machinery. Engine auxiliary drives, such as ventilation and/or water pump and/or oil pump can be provided at the free end of the crankshaft disposed opposite the flywheel. In addition, power can also be taken for the application at the front crankshaft end.

The nomenclature used in accordance with the invention to designate the individual crank throws 9 is shown in FIG. 1. Accordingly, the crank throws are numbered in ascending order from C1 to C10, starting at the flywheel side. The numbering of the individual cylinders is in accordance with DIN ISO 1204, and is depicted in FIG. 3. The drawing shows the four-stroke reciprocating internal combustion engine in a plan view from above, with the flywheel 6 and the cylinders 4 being drawn. The crankshaft is located beneath the cylinders. The direction of rotation is defined in accordance with DIN ISO 1204 in a view from the power output side of the engine to the crankshaft, i.e. looking from the flywheel side of the engine to the crankshaft.

It will be described in the following how the parameters of the four-stroke reciprocating internal combustion engine in accordance with the invention and in particular the firing sequences and the crank stars were determined. In this respect, in the embodiment, a combination of the first and second aspect of the present invention is present.

Fundamental Aspects of the Optimization

In reciprocating internal combustion engines, the crankshaft is subject to different kinds of load. The bending load of the individual crank throws must be named first, which arises through the cylinder pressure and the accelerated masses of the individual crank drives. In addition, the crankshaft is subject to a time-variable torsional load, which results from the torques of the individual crank drives. In addition to these quasi-static types of load, torsional vibrations are excited in the crankshaft by the transient development of the torques of the individual crank drives. The dynamic load can exceed the quasi-static torsional load by a multiple.

Besides various criteria related to torsional dynamics, further aspects have to be considered when defining the engine's V-angle, the crank star, and a suitable firing sequence. Namely, these are the crankshaft mass balancing, the gas exchange process, the load on the crankshaft bearings, and the operating vibrations of the engine. As the number of possible firing sequences grows proportional to the factorial of the number of cylinders, finding a suitable firing sequence becomes more and more difficult with increasing number of cylinders. Without any restriction, the total number of firing sequences for 20V cylinder is $(N_{cyl}-1)!>10^{17}$ where $N_{cyl}$ represents the number of cylinder. By considering only lengthwise symmetric crankshafts, this number could be reduced to 12,288 firing sequences (24 crank stars with 512 firing sequences per crank star). However, by including lengthwise asymmetric crankshafts, 185,794,560 firing sequences are theoretically possible (362,880 crank stars with 512 firing sequences per crank star). In addition, the application of optimization algorithms is not straightforward, as the optimization parameter firing sequence is of discrete nature, and the correlation between firing sequence and several evaluation criteria, such as bearing load and gas cycle dynamics, has large discontinuities.

The variety of criteria to be considered in combination with the large number of possible firing sequences requires the use of methods of multi-criteria optimization. The discrete and partially discontinuous nature of the optimization problem prevents the use of purely deterministic optimization algorithms. A comprehensive evaluation can, in contrast, be achieved by a complete assessment of the criteria for all solutions ("design of experiments"). In this respect, the calculation effort can be reduced to a reasonable level by a hierarchical optimization approach.

V-Angle and Fundamental Crankshaft Topology

For the selection of the engine's V-angle, various aspects have to be considered carefully. First, the V-angle decisively determines the height and the width of the engine's design space. The firing intervals of the engine are furthermore determined by the V-angle, unless split pins of the crank throws are introduced. The regularity of the firing intervals, in turn, has a substantial influence on the both the rotational irregularity of the flywheel, and the torsional dynamics of the crankshaft. Furthermore, the forces in the crankshaft bearings are dependent on the V-angle as well, since it defines the directions of the cylinder forces and, via the firing interval, the degree of superposition of the single cylinder forces in a bearing.

For the development of a robust engine with moderate crankshaft torsional stress, it is of advantage to select a crank train configuration which is adapted to the number of cylinders, and which results in equidistant firing intervals. In addition to the V-angle, the crankshaft topology plays an important role here. In modern, fast-running four-stroke reciprocating internal combustion engines, the connecting rods of a V-segment are typically connected to a common crank throw. In general, for the arrangement of the crank throws along the crankshaft, the so-called crank star, two different topologies must be distinguished. The so-called simple crank star is characterized by an even distribution of the crank throws over the angular range of 360°. The resulting crank star angle is thus obtained as $$\varphi_K = \frac{2 \cdot 360°}{N_Z}.$$

Here, Nz designates the number of cylinders. For the V20 configuration under consideration, this results in a crank star angle of $\varphi_K 36°$. Equidistant firing interval angles $\varphi_Z$ are achieved for a selection of the V-angle $\alpha_V$ according to $$\alpha_V = k \cdot \varphi_K, \text{ with } k = 1, 2 \ldots .$$

In this case, the firing interval angle is equal to the crank star angle. For the V20 configuration, possible V-angles are thus $\alpha_V$=36°, 72°, and 108°.

Figure 4:
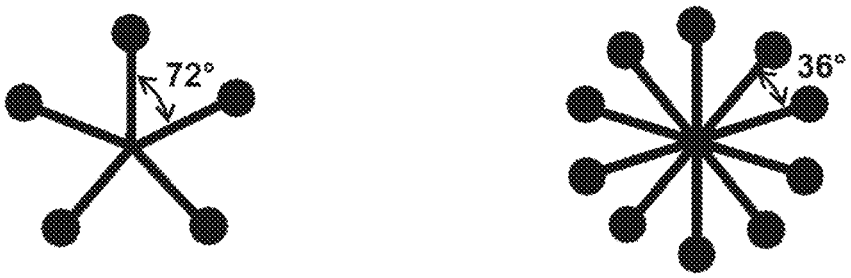
FIG. 4: a 20 cylinder V-type crank star; Left: double type crank star, Right: single type crank star.

With the so-called double crank star, two respective crank pins are located at the same angular position in the crank star, FIG. 4. A special case in this context are the so-called central symmetric crankshafts, where, the crank throws are arranged along the crankshaft symmetrically with respect to the crankshaft center. For engines with twelve cylinders or more, crank trains with central symmetric crankshafts provide the advantage of absence of free mass forces and moments. Accordingly, symmetric crankshafts are quite common for these engines.

The following requirement for the crank star angle applies to double crank stars, $$\varphi_K = \frac{4 \cdot 360°}{N_Z}.$$

Thus, a crank angle of $\varphi_K$=72° results for the V20 engine. Equidistant firing interval φZ is achieved for a selection of the V-angle $\alpha_V$ according to $$\alpha_V = k \cdot \frac{\varphi_K}{2}, \text{ with } k = 1, 3, 5 \ldots .$$

In this case, the firing interval is equal to half the crank star angle. For the V20 engine, this gives possible V-angles of $\alpha_V$=36°, and 108°.

Further restrictions must be considered for the selection of the V-angle. A hard limit for the lower bound of the V-angle is defined by the contact between cylinder liners of opposite banks. Horizontal components of crankshaft bearing forces increase directly with the V-angle, which has to be considered for dimensioning of the bearings as well as the surrounding structure. V-angles above 120° are considered to be critical in terms of high loads on sensitive bearing shell split line. Here, the risk of increased wear or bearing seizure is given. Further, production efficiency and costs are an important factor.

For the embodiment under consideration, a V-angle of 60° was chosen. This V-angle is inherited from smaller members of the engine family for the reason of design communality. On the one hand, this simplifies the design and enables similar packaging of aggregates. Furthermore, a reduction of tooling cost for the crankcase forge can be achieved. As consequence, the option of choosing optimal cranktrain configuration for each engine size is abandoned.

In order to improve the combustion regularity for the V-angle of 60°, a lengthwise asymmetric crankshaft concept has been used. The related crank star is called single type crank star because of only one crank throw is positioned in a given angular position, FIG. 4. In this concept, firing sequences with and without bank alternating (exp. A-B, B-A, A-A and B-B) are possible which allows for further theoretical firing sequences.

As discussed above, optimal equidistant firing of 36° for all bank sequences would be obtained for a V-angle of 72°. However, with 60° of V-angle and for counter-clockwise rotation, angular firing distances differ depending on the bank sequences:

36° for A-A or B-B sequence,

48° for A-B sequence

24° for B-A sequence

For clockwise rotation, angular firing distances are:

36° for A-A or B-B sequence,

24° for A-B sequence

48° for B-A sequence

Compared to a double type crank star concept (alternating firing distances of 60°-15°), combustion regularity is thereby significantly improved by means of less variation of intervals. This results in better control of engine excitations which reduces engine vibration levels and allows for longer lifetime of different engine components.

Crankshaft Mass Balancing

Figure 5:
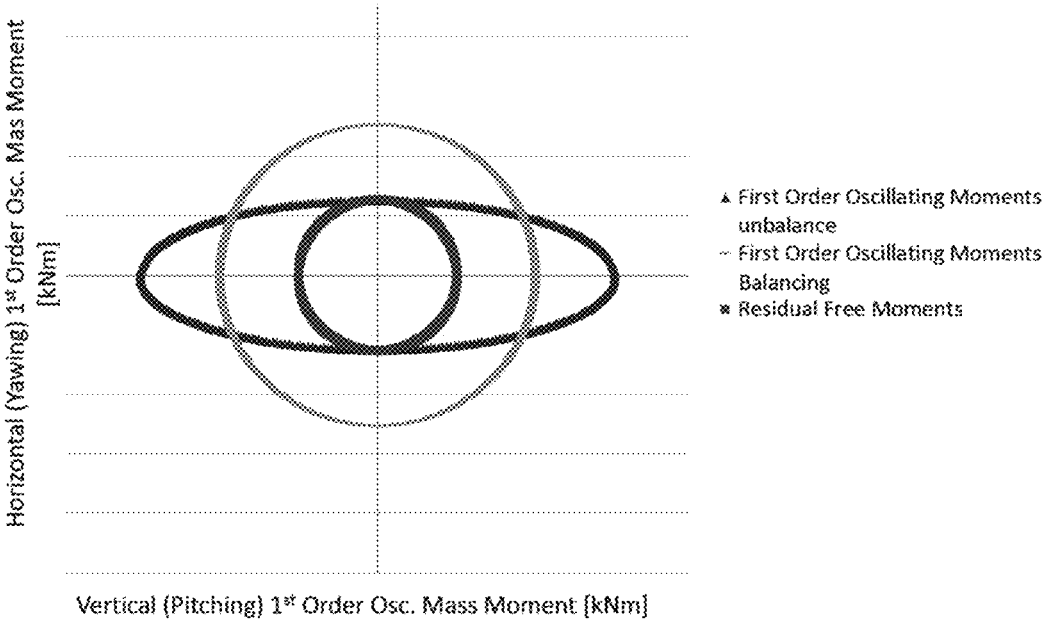
FIG. 5: balancing of vertical and horizontal $1^{st}$ order oscillating mass moments.
Figure 6:
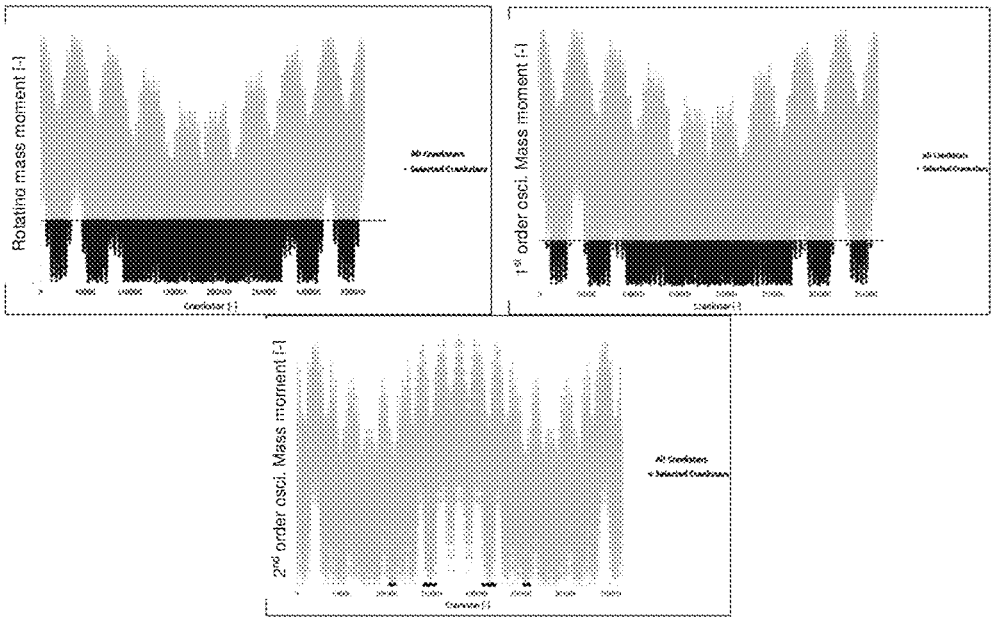
FIG. 6: optimization of 20V cylinder firing sequences based on rotating mass moment, $1^{st}$ order oscillating mass moment and $2^{nd}$ order oscillating mass moment.

In reciprocating combustion engines, the acceleration of the cranktrain rotating and oscillating masses causes inertia forces acting on the engine structure. The purpose of global mass balancing is to eliminate all remaining forces and moments acting on the engine, while the inner balancing focuses on the resulting bending moment acting on the engine block. Both global and inner mass moments depend strongly on the crank star, as it defines the phase shift between the single mass forces. A common measure to prevent free mass moments for multi-cylinder engines is to choose a lengthwise symmetric crankshaft. Free forces and moments related to rotating, $1^{st}$ and $2^{nd}$ orders oscillating masses are thereby inherently vanishing. This is not the case with the selected lengthwise asymmetric crankshaft where only rotating and oscillating free mass forces vanish. However, all free moments related to rotating, $1^{st}$ and $2^{nd}$ orders oscillating masses are different to zero. Therefore, by adding the counterweights in 20-cylinders engine with V-angle of 60°, only 100% rotating mass moment and 50% of $1^{st}$ order oscillating mass moments could be compensated, FIG. 5. Accordingly, $1^{st}$ order oscillating free mass moments in horizontal and vertical directions superimposed to $2^{nd}$ order oscillating free mass moments prone to engine block vibration. Based on free moments of rotating and oscillating masses criteria, only advantageous 24 crank stars have been kept for further investigations, FIG. 6. By this, the number of firing sequences to be assessed is reduced to 12,288.

Figure 7:
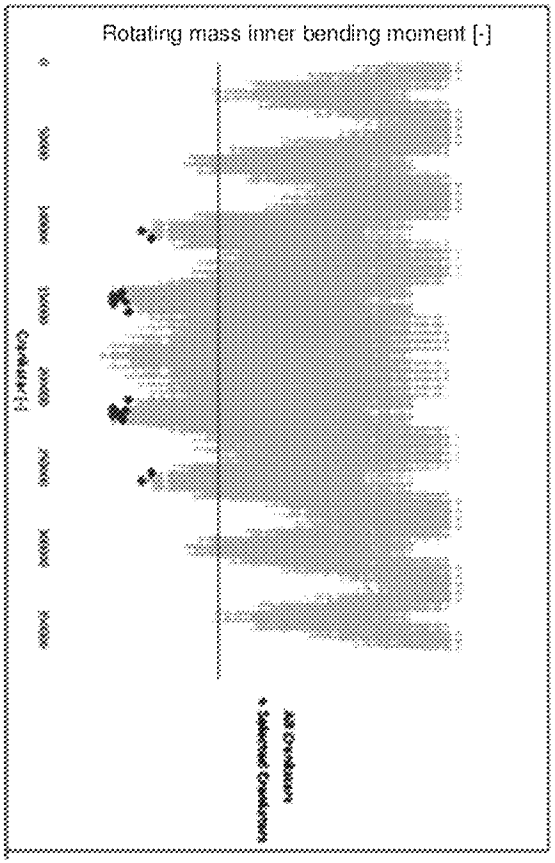
FIG. 7: optimization of 20V cylinder firing sequences based on inner bending moment.

Regarding the inner balancing, two different aspects have to be considered. The bending moment caused by the rotating masses and a part of the $1^{st}$ order oscillating mass forces for V-engines can be compensated by applying crankshaft counterweights. However, this lowers significantly the torsional eigenfrequencies of the cranktrain, which is in general not desired for torsional dynamic reasons. The previously selected 24 crank stars have also a good performance in terms of inner bending moment, FIG. 7.

For long engines of the considered size, especially the bending moments caused by the $2^{nd}$ order oscillating mass forces can excite the bending eigenmodes of the engine block structure, and thus lead to an increased vibration level. At this stage, this aspect is not covered during the firing sequence optimization, but is assessed afterwards by means of a detailed 3D operational vibration analysis.

Gas Exchange Process

In general, the filling of a cylinder depends strongly on the local pressure at the corresponding location in the intake manifold during the intake phase. This, however, depends strongly on the spatial distance which is kept to the previously fired cylinder on the same intake manifold. In order to achieve a well-balanced filling between the cylinders, it is recommended to keep a sufficiently large distance between consecutively fired cylinders on the same intake manifold. At the exhaust side, the situation is more complex, as the wave propagation of the exhaust gas can play an important role.

The considered 20 cylinder V-engine has a single intake manifold per bank. Therefore, in order to assess the intake related filling behavior, some thermodynamic aspects are firstly considered by means of indicators. One of these indicators is named Bank Consecutive Firing Chain Length BCFCL which characterizes the minimum requirement for one pair of consecutive firings on each bank. This represents the maximum number of consecutively fired cylinders on a bank. For lengthwise asymmetric crankshafts, it is theoretically possible to have up to 10 consecutive firings on the same bank. To avoid high cylinder air volumetric efficiency deviations, only firing sequences with bank Consecutive Firing Chain Length equal to 2 are selected. By using the aforementioned consideration, the number of firing sequences to be assessed is reduced to 1,080.

Additional indicator which is the so-called Number of Bank Consecutive Firing BCF is considered herein. This indicator corresponds to the number of bank consecutive firings of length 2, i.e. occurrences of intervals of type A-A or B-B within the firing sequence. In the framework of 20V lengthwise asymmetric crankshaft, three values of number of bank consecutive firing are possible:

2 bank consecutive firings,

Exp.: A1-A8-B2-A6-B3-A10-B5-A7-B1-A9-B4-B6-A4-B10-A2-B7-A3-B9-A5-B8

6 bank consecutive firings,

Exp.: A1-A5-B2-A4-B6-B3-A6-B9-B1-A9-B8-B4-A8-B10-A2-A10-B7-A3-A7-B5

10 bank consecutive firings,

Exp.: A1-A6-B2-B10-A2-A10-B7-B9-A7-A9-B8-B4-A8-A4-B5-B3-A5-A3-B1-B6

Based on 1D torsional vibration assessment, these firing arrangements show a clear effect on the contribution of the dominant order excitation. Accordingly, all the 1,080 firing sequences under consideration are kept for further investigation.

Crankshaft Torsional Dynamics

Figure 8:
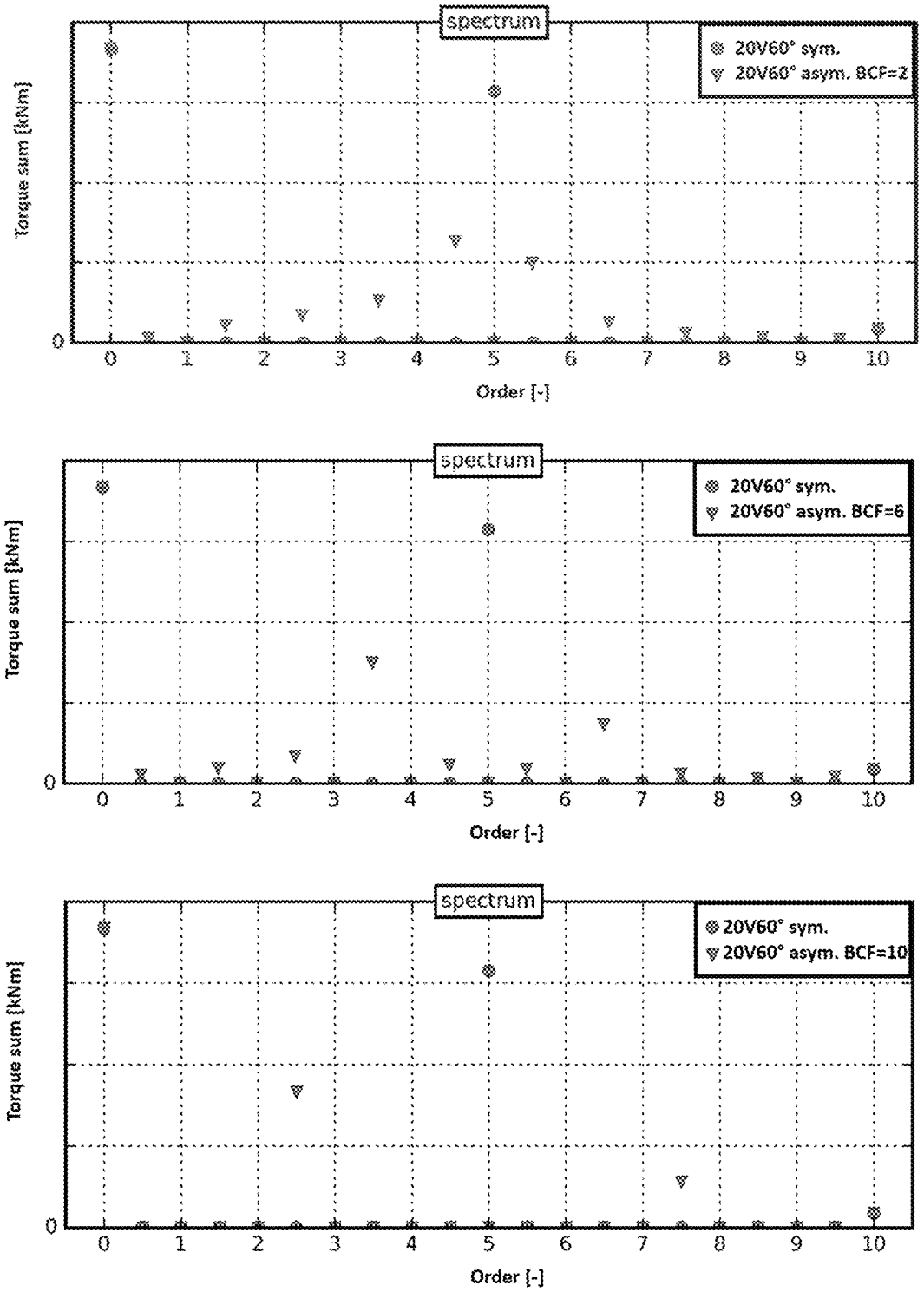
FIG. 8: comparison of torque sum spectrum: 20V60° lengthwise symmetric crankshaft and 20V60° lengthwise asymmetric crankshaft for BCF equal to 2, 6 and 10.

The torque variation resulting from single cylinder combustion shifted by the firing sequence leads to an excitation of torsional vibrations of the crankshaft. Torsional dynamics of V20 engines with symmetric crankshaft and non-natural V-angle like 60° are characterized by dominant occurrence of $5^{th}$ order. In case of simple type asymmetric crankshafts, a purely alternating firing sequence is not possible. Indeed, it is necessary to introduce at least two consecutive firings on the same bank, i.e. A-A and B-B intervals. The number of how often inner-bank firing intervals A-A or B-B occur in a firing sequence is characterized by the Bank Consecutive Firing index BCF. As discussed above, for the V20 under consideration, firing sequences with values for BCF of 2, 6, and 10 are possible. A consequence of inner-bank firing intervals is that the $5^{th}$ order excitation, which was dominant for alternating firing sequence, is eliminated entirely. Depending on the BCF number, the $5^{th}$ order excitation is replaced by different side orders with lower amplitudes, see FIG. 8. The summation of the contribution of both dominant orders especially for BCF=10 is more distinct and favorable for the reduction of vibration levels, FIG. 8.

Figure 9:
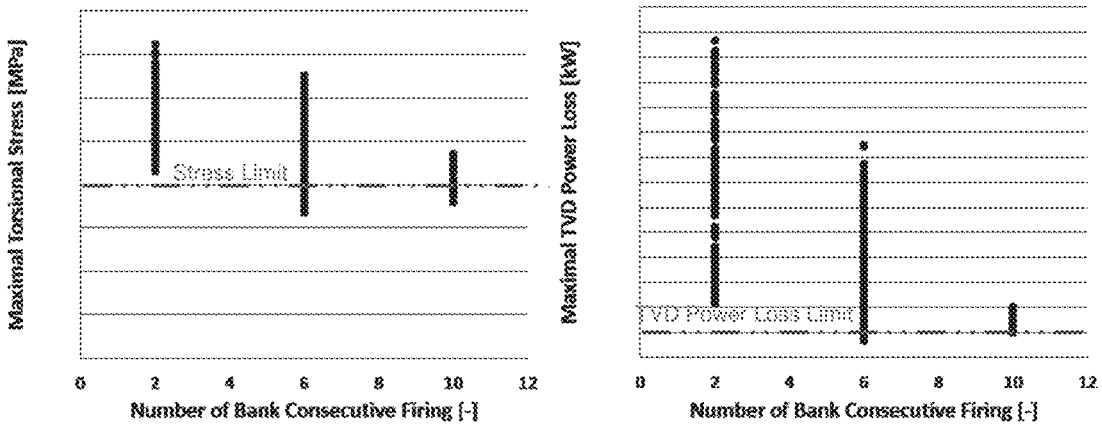
FIG. 9: torsional vibration evaluation based on different values of BCF.
Figure 10:
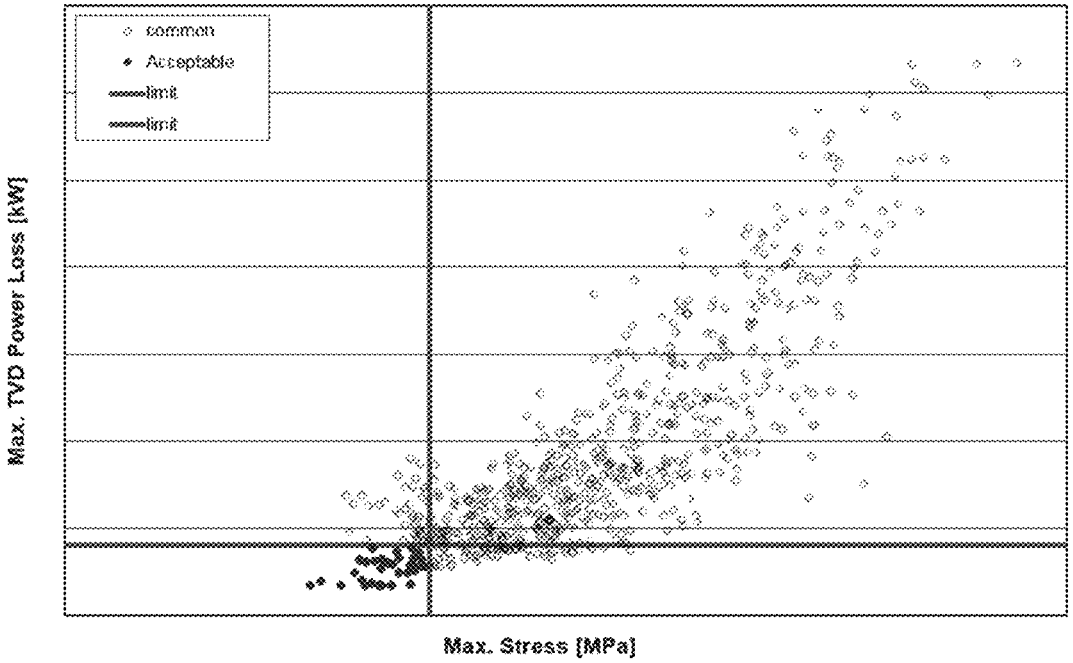
FIG. 10: firing sequence optimization based on torsional vibration criteria.

This could be well understood in the framework of 1D torsional vibration simulation for different values of BCF. To do that, harmonic rotational amplitudes of the lumped inertia model can be achieved by means of a classical forced response calculation in frequency domain. In the FIG. 9, firing sequences with BCF=2 exceed the limit for crankshaft maximal torsional stress as well as the TVD power loss limit for the concerned applications. However, firing sequences with BCF=6 or 10 show 36 favorable candidates for further investigations. This crankshaft torsional dynamic improvement is illustrated in FIG. 10.

Crankshaft Axial Dynamics

A general drawback of V20 engines with bank-alternating firing sequences and non-natural V-angle is the occurrence of dominant $5^{th}$ order crankshaft axial vibration.

Axial vibrations represent a direct result of the crankshaft design and the attached masses, namely flywheel, coupling, torsional damper, and conrods. Here, the occurrence of axial resonances in the engine speed range leads to a succession of lengthening and shortening of the crankshaft. This can be of specific importance for engines with high number of cylinders and correspondingly long crankshafts. For the V20 under consideration, resonance of dominant $5^{th}$ order is typically located in the full torque speed range. Operating under axial resonance results in excessive increase of fillet stresses as well as very high loads on the axial thrust bearing. Furthermore, high axial accelerations at the crankshaft's front end typically occur. Unlike technical measures to avoid torsional and bending dynamics, efficient solutions for controlling crankshaft axial vibration are not clearly identified in literature today. Axial vibration dampers are rarely used in high-speed Diesel engines, and are always considered as encumbering devices from design space standpoint resulting in an extra cost. Without controlling crankshaft axial behaviour, its effect is considered by means of additional unknown stresses or increasing safety factor margins when analysing fatigue results.

As for torsional excitation, dominant axial excitation order 5 is eliminated the same way by introducing inner-bank firing intervals A-A or B-B. Excitation energy is distributed on two different excitation orders below and above the $5^{th}$ order. Further, depending on the engine design and speed range, the corresponding resonance speeds can be shifted outside the operating speed range.

Figure 11:
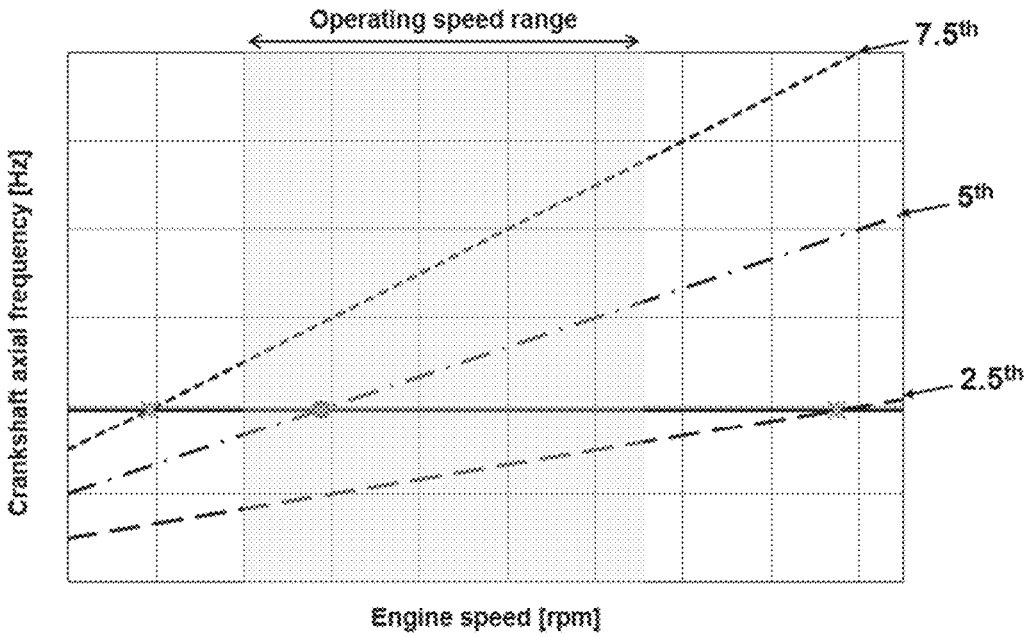
FIG. 11: crankshaft axial vibration improvement based on Campbell diagram.

FIG. 11 shows how $5^{th}$ order in asymmetric 20V crankshaft, is split into two sub-dominant orders 2.5 and 7.5 in the case of BCF equal to 10. This results in an axial resonance speeds which:

exceeds the engine speed range of the considered applications for order 2.5 is located at low engine speed range where the excitation is not significant for order 7.5.

Main Bearing Load

The last criterion, and not the least, is main bearing load. In fact, wear and fatigue of crankshaft main bearings depend on many aspects and has to be assessed carefully during the development of the base engine. The firing sequence affects the main bearing load in several ways. Besides the contribution from cylinder pressure, the bearing peak force depends also on the mass balancing, which is determined by the crank star, and is thus depending on the chosen firing sequence. Additionally, a considerable bearing force is induced by the dynamic torsion of the crankshaft. The firing sequence decides whether this additional load is superposed in-phase with the peak firing load, or not. Furthermore, regarding thermal load of a bearing, it is advantageous to keep a certain time interval between two consecutive peak loads in order to allow for sufficient cooling by oil flushing. A simple measure for this is to regard the maximum number of consecutive peak loads on a bearing.

Figure 12:
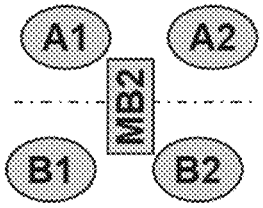
FIG. 12: main bearing load index illustration.

An evaluation index could be defined which is called maximum Bearing Load Index BLI. It represents the maximum number of consecutive firings on crank throws adjacent to same main bearing, FIG. 12. For the considered 20V engine, the maximum bearing load index is between 1 and 4. For the optimization, only firing sequences with maximum BLI equal to 2 are kept. Accordingly, 13 favorable candidates are considered for further investigations.

Torsional dynamics of the Camshaft

As for the crankshaft, torsional dynamics of the camshaft is also affected significantly by the firing sequence. On the one hand, there exists a coupling between crankshaft and camshaft via the timing drive, which transmits crankshaft vibrations as excitation to the camshaft. Furthermore, the phase offset of the torque loads on the individual valve drives is also determined by the firing sequence. Depending on the size and design as well as in dependence of possible auxiliary consumers driven via the camshaft, such as the engine coolant pump, substantial vibration amplitudes can occur here. They have to be evaluated in a separate torsional vibration calculation, and the design has to take corresponding account of the stresses which occur. The torsional dynamics of the camshaft is, however, not taken into account in the firing sequence optimization, since experience has shown that for a robust design of the camshaft, the torsional stress level remains relatively low, and there exist sufficient technical possibilities to face the torsional stress.

Figure 13A:
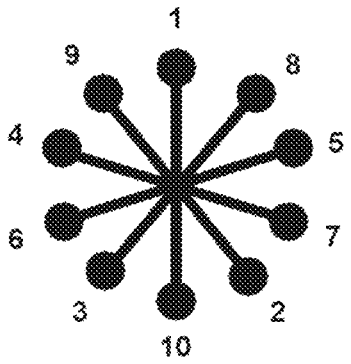
FIGS. 13A to 13C: the star configurations according to the second aspect of the present invention for counter-clockwise rotation.
Figure 13A:
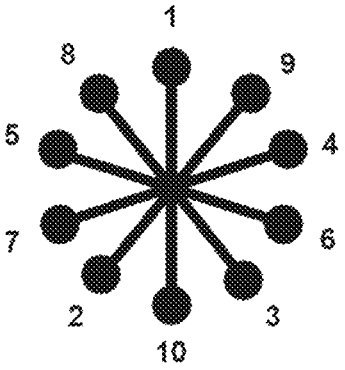
Figure 13A:
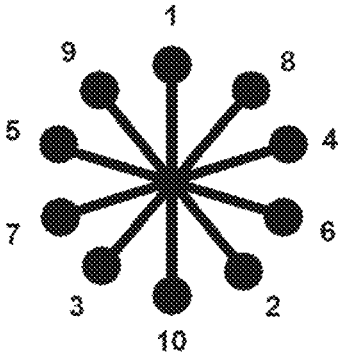
Figure 13B:
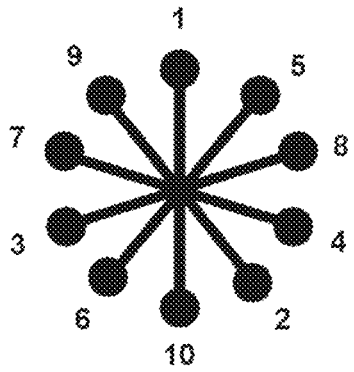
Figure 13B:
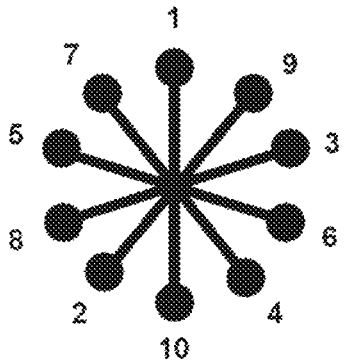
Figure 13B:
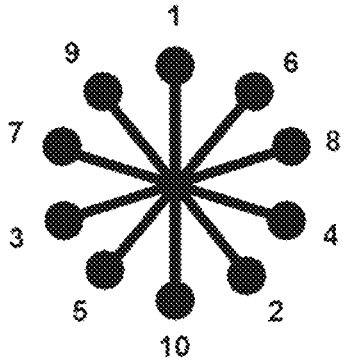
Figure 13C:
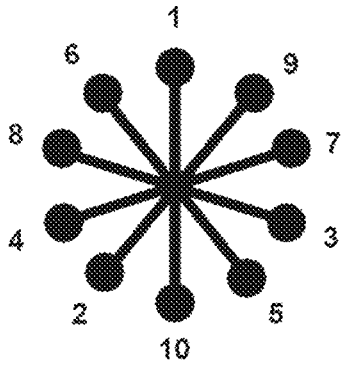
Figure 13C:
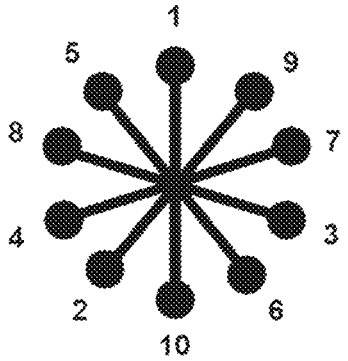
Figure 13C:
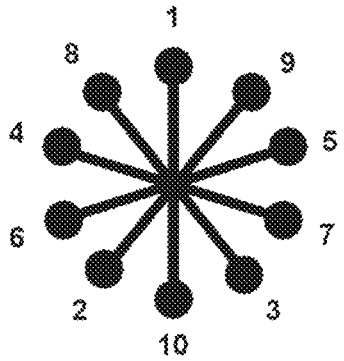
Figure 14A:
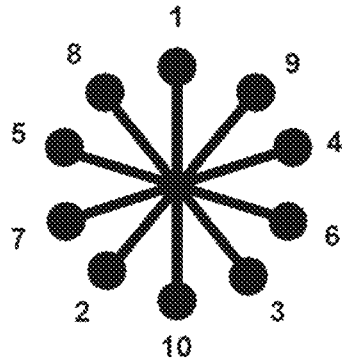
FIGS. 14A to 14C: the crank star configurations to the second aspect of the present invention for clockwise rotation.
Figure 14A:
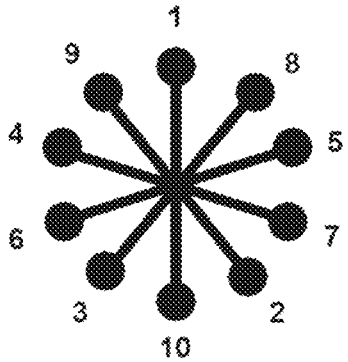
Figure 14A:
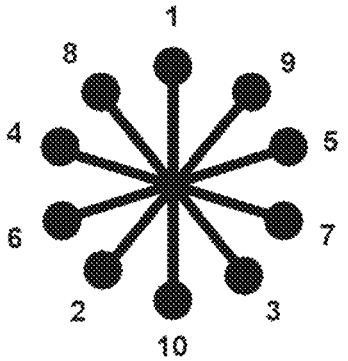
Figure 14B:
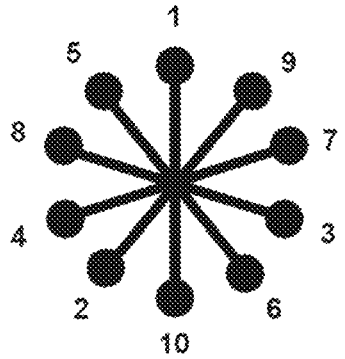
Figure 14B:
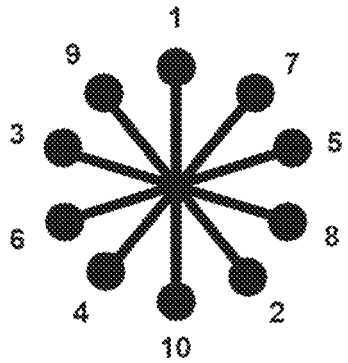
Figure 14B:
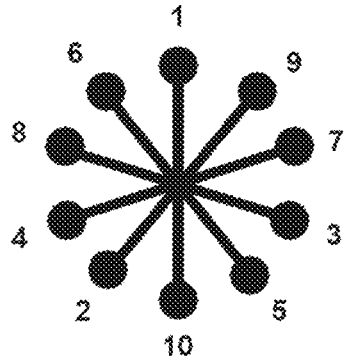
Figure 14C:
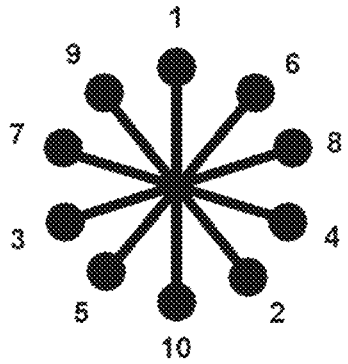
Figure 14C:
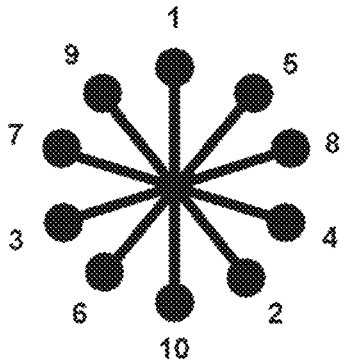
Figure 14C:
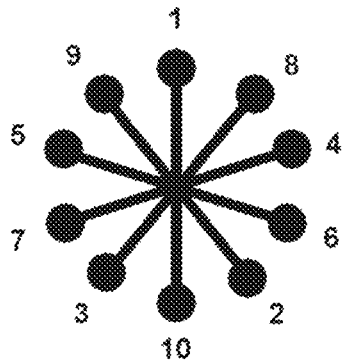

After finalizing the multi-criteria optimization, the optimized crank stars selected in accordance with the invention are shown in FIGS. 13A/13B/13C for engines with a counter-clockwise direction of rotation, and in FIGS. 14A/14B/14C for engines with a clockwise direction of rotation. As can be seen from the figures, the crank stars for the two different directions of rotation have the same sequence of crank throws with respect to the direction of rotation.

In FIGS. 13A/13B/13C and 14A/14B/14C, a view from the flywheel side onto the crankshaft along the crankshaft axis is shown. The crank throws are numbered in accordance with the nomenclature shown in FIG. 1, with the letter "C" having been omitted, such that the crank throws are numbered from 1 to 10 starting at 1 on the flywheel side, with the crank throws 1 to 10 shown in FIGS. 13A/13B/13C and 14A/14B/14C corresponding to the crank throws C1 to C10 of FIG. 1.

In the embodiment, the individual crank throws are arranged equidistantly, i.e. crank throws following one another in the angle of rotation each have an angular spacing of 36°. The present invention is, however, not restricted to such an equidistant arrangement. However, at least quasi-equidistant angular spacing is preferred.

The firing sequences obtained by the optimization are given below, with the nomenclature shown in FIG. 3 in accordance with DIN ISO 1204 used to designate the cylinders. Further, the preferred crank stars from FIGS. 13A/13B/13C and 14A/14B/14C used for the optimized firing sequences are provided:

1. Firing sequences for counter-clockwise rotation

Crankstar CS i)

h) A1-A8-B2-A7-B3-A10-B4-A6-B1-A9-B5-B7-A5-B10-A2-B6-A3-B9-A4-B8

Crankstar CS ii)

i) A1-B6-A4-B10-A3-B7-A2-B8-B1-A8-B4-A9-B3-A6-B2-A10-B5-A7-A5-B9

Crankstar CS iii)

g) A1-A8-B2-A6-B3-A10-B5-A7-B1-A9-B4-B6-A4-B10-A2-B7-A3-B9-A5-B8

Crankstar CS iv)

a) A1-A5-B2-A4-B6-B3-A6-B9-B1-A9-B8-B4-A8-B10-A2-A10-B7-A3-A7-B5 b) A1-B4-B2-A4-B6-B3-A6-B9-B1-A9-B8-A5-A8-B10-A2-A10-B7-A3-A7-B5 m) A1-A5-B2-B10-A2-A10-B7-B9-A7-A9-B8-B4-A8-A4-B6-B3-A6-A3-B1-B5

Crankstar CS v)

j) A1-B6-A3-B10-A4-B8-A2-A8-B1-A7-B3-A9-B4-A6-B2-A10-B5-B7-A5-B9

Crankstar CS vi)

c) A1-A6-B2-A4-B5-B3-A5-B9-B1-A9-B8-B4-A8-B10-A2-A10-B7-A3-A7-B6 d) A1-B4-B2-A4-B5-B3-A5-B9-B1-A9-B8-A6-A8-B10-A2-A10-B7-A3-A7-B6 l) A1-A6-B2-B10-A2-A10-B7-B9-A7-A9-B8-B4-A8-A4-B5-B3-A5-A3-B1-B6

Crankstar CS vii)

e) A1-A9-B5-A3-A5-B4-A2-A4-B1-A6-B7-B3-A7-B10-B2-A10-B8-B6-A8-B9

Crankstar CS viii)

f) A1-A9-B6-A3-A6-B4-A2-A4-B1-A5-B7-B3-A7-B10-B2-A10-B8-B5-A8-B9

Crankstar CS ix)

k) A1-B7-A5-B10-A3-B6-A2-B8-B1-A8-B5-A9-B3-A7-B2-A10-B4-A6-A4-B9

2. Firing sequences for clockwise rotation

Crankstar CS i)

h) B1-B8-A2-B7-A3-B10-A4-B6-A1-B9-A5-A7-B5-A10-B2-A6-B3-A9-B4-A8

Crankstar CS ii)

i) B1-A6-B4-A10-B3-A7-B2-A8-A1-B8-A4-B9-A3-B6-A2-B10-A5-B7-B5-A9

Crankstar CS iii)

g) B1-B8-A2-B6-A3-B10-A5-B7-A1-B9-A4-A6-B4-A10-B2-A7-B3-A9-B5-A8

Crankstar CS iv)

a) B1-B5-A2-B4-A6-A3-B6-A9-A1-B9-A8-A4-B8-A10-B2-B10-A7-B3-B7-A5 b) B1-A4-A2-B4-A6-A3-B6-A9-A1-B9-A8-B5-B8-A10-B2-B10-A7-B3-B7-A5 m) B1-B5-A2-A10-B2-B10-A7-A9-B7-B9-A8-A4-B8-B4-A6-A3-B6-B3-A1-A5

Crankstar CS v)

j) B1-A6-B3-A10-B4-A8-B2-B8-A1-B7-A3-B9-A4-B6-A2-B10-A5-A7-B5-A9

Crankstar CS vi)

c) B1-B6-A2-B4-A5-A3-B5-A9-A1-B9-A8-A4-B8-A10-B2-B10-A7-B3-B7-A6 d) B1-A4-A2-B4-A5-A3-B5-A9-A1-B9-A8-B6-B8-A10-B2-B10-A7-B3-B7-A6 l) B1-B6-A2-A10-B2-B10-A7-A9-B7-B9-A8-A4-B8-B4-A5-A3-B5-B3-A1-A6

Crankstar CS vii)

e) B1-B9-A5-B3-B5-A4-B2-B4-A1-B6-A7-A3-B7-A10-A2-B10-A8-A6-B8-A9

Crankstar CS viii)

f) B1-B9-A6-B3-B6-A4-B2-B4-A1-B5-A7-A3-B7-A10-A2-B10-A8-A5-B8-A9

Crankstar CS ix)

k) B1-A7-B5-A10-B3-A6-B2-A8-A1-B8-A5-B9-A3-B7-A2-B10-A4-B6-B4-A9

Influence of Size, Specific Power, and the Engine's V-Angle

The specification of a firing sequence does not only define the sequence with which the individual combustion chambers of the engine are supplied with fuel and fired, but rather determines also the topology of the underlying crankshaft. Conversely, the number of possible firing sequences is reduced significantly by defining a specific crank star.

There is furthermore a correlation between possible firing sequences and the V-angle. From a kinematic point of view, the firing sequences with an asymmetric crankshaft listed for the V20 under consideration, are feasible in a V-angle range between 54° and 108°. However, the advantageous properties are mostly developed at V-angle of 60° and the direct surrounding. The advantageous properties with respect to crankshaft bearing load and the gas exchange process are largely insensitive with respect to a variation of the V-angle. The torsion dynamics of the cranktrain, in contrast, reacts comparatively sensitive with respect to a variation of the V-angle. Angular ranges of approximately ±10° around the chosen V-angle are thus preferred.

The present study is based on an engine series with a 175 mm bore diameter and 5.17 liters cylinder displacement. The specific power amounts to 44 kW per liter; the speed range is between 600 and 2100 r.p.m. The effective moment of inertia of the total cranktrain including the flywheel amounts to approximately 33 $kgm^2$. It is, however, expected that the results maintain their validity over a wide range. It can basically be assumed that the advantageous properties with respect to the torsional dynamics are equally present in a range of displacement between approximately 1 to 20 liters, preferably from 1.5 to 10 liters per cylinder.

The present invention is not restricted to specific types of construction of a four-stroke reciprocating internal combustion engine. Reciprocating internal combustion engines in accordance with the invention can thus be operated in accordance with a diesel or gasoline internal combustion method. In this respect, both homogeneous and alternative combustion methods are conceivable.

The four-stroke reciprocating internal combustion engines in accordance with the invention can furthermore be operated with any desired fuel. The design in accordance with the invention and the sequences in accordance with the invention are in particular of advantage, independently of the selected fuel. For example, the engine can be a gas engine, in particular a gasoline engine, which can be operated with a gaseous fuel such as hydrogen, natural gas, or liquefied gas. It can, however, also be an engine which is operated with liquid fuels.

Furthermore, the engine can be a naturally aspirated engine, i.e. without any supercharging. Just as well, the present invention can also be used in engines having a single-stage or multi-stage charging system.

The coupling between the engine and the driveline can be either torsionally stiff, or flexible by means of an elastic coupling.

Application Possibilities

Four-stroke reciprocating internal combustion engines in accordance with the invention can be used in a variety of different applications.

In the optimization of the firing sequences, the general application "heavy duty" with a torsional elastically coupled drivetrain was considered. Since this is the case in most industrial applications of the examined power class, this case covers a plurality of the most varied areas of application.

Possible application might be a power unit of heavy-duty machines and mining machinery, either mobile or stationary. Corresponding mining machinery can be used both in underground and in strip mining. This can be, for example, a dump truck or an excavator.

A further field of application is the use as main propulsion of a ship.

The engine can furthermore be used as a main drive in a rail vehicle. For example, the engine can drive an electric generator, which produces the electricity for driving the rail vehicle. Alternatively, the propulsion can also take place via a transmission, with or without torque converter.

The engine in accordance with the invention can furthermore also be used in heavy military applications, such as for driving armored vehicles, rocket carriers, speedboats and submarines.

The engine can furthermore be used as a power unit in the oil and gas industry, in particular for driving pumps. A use of the engine as a drive in conveying technology and in particular as a pump drive is also conceivable outside the oil and gas industry.

The engine in accordance with the invention can be used for stationary or mobile power generation.

The invention claimed is:

1. A V-type 4-stroke internal combustion engine having 20 cylinders, having a counter-clockwise or clockwise direction of rotation, comprising a crankshaft, a torsional vibration damper and a flywheel arranged on the crankshaft, wherein the crankshaft has 10 crank throws forming a crank star, wherein in each case piston rods of two cylinders of a V-segment are connected to a same crank throw, wherein crank throws C1 to C10 have one of the following angular sequences in the direction of rotation of the engine when seen from a side of the flywheel, with the crank throws numbered as C1 to C10 when starting from the side of the flywheel:

i) C1, C9, C4, C6, C3, C10, C2, C7, C5, C8
ii) C1, C8, C5, C7, C2, C10, C3, C6, C4, C9
iii) C1, C9, C5, C7, C3, C10, C2, C6, C4, C8
iv) C1, C9, C7, C3, C6, C10, C2, C4, C8, C5
v) C1, C7, C5, C8, C2, C10, C4, C6, C3, C9
vi) C1, C9, C7, C3, C5, C10, C2, C4, C8, C6
vii) C1, C6, C8, C4, C2, C10, C5, C3, C7, C9
viii) C1, C5, C8, C4, C2, C10, C6, C3, C7, C9
ix) C1, C8, C4, C6, C2, C10, C3, C7, C5, C9.

2. The V-type 4-stroke internal combustion engine according to claim 1, having a counter-clockwise direction of rotation, comprising a firing sequence controller that fires cylinders A1 to A10 and B1 to B10 in at least one of the following firing sequences, wherein the direction of rotation and the cylinder numbering is defined in accordance with DIN ISO 1204:

a) A1-A5-B2-A4-B6-B3-A6-B9-B1-A9-B8-B4-A8-B10-A2-A10-B7-A3-A7-B5
b) A1-B4-B2-A4-B6-B3-A6-B9-B1-A9-B8-A5-A8-B10-A2-A10-B7-A3-A7-B5
c) A1-A6-B2-A4-B5-B3-A5-B9-B1-A9-B8-B4-A8-B10-A2-A10-B7-A3-A7-B6
d) A1-B4-B2-A4-B5-B3-A5-B9-B1-A9-B8-A6-A8-B10-A2-A10-B7-A3-A7-B6
e) A1-A9-B5-A3-A5-B4-A2-A4-B1-A6-B7-B3-A7-B10-B2-A10-B8-B6-A8-B9
f) A1-A9-B6-A3-A6-B4-A2-A4-B1-A5-B7-B3-A7-B10-B2-A10-B8-B5-A8-B9
g) A1-A8-B2-A6-B3-A10-B5-A7-B1-A9-B4-B6-A4-B10-A2-B7-A3-B9-A5-B8
h) A1-A8-B2-A7-B3-A10-B4-A6-B1-A9-B5-B7-A5-B10-A2-B6-A3-B9-A4-B8
i) A1-B6-A4-B10-A3-B7-A2-B8-B1-A8-B4-A9-B3-A6-B2-A10-B5-A7-A5-B9
j) A1-B6-A3-B10-A4-B8-A2-A8-B1-A7-B3-A9-B4-A6-B2-A10-B5-B7-A5-B9
k) A1-B7-A5-B10-A3-B6-A2-B8-B1-A8-B5-A9-B3-A7-B2-A10-B4-A6-A4-B9
l) A1-A6-B2-B10-A2-A10-B7-B9-A7-A9-B8-B4-A8-A4-B5-B3-A5-A3-B1-B6
m) A1-A5-B2-B10-A2-A10-B7-B9-A7-A9-B8-B4-A8-A4-B6-B3-A6-A3-B1-B5.

3. The V-type 4-stroke internal combustion engine according to claim 2, wherein the combination of firing sequence and crank star is one of the following:

crank star i), firing sequence h
crank star ii), firing sequence i
crank star iii), firing sequence g
crank star iv), one of the firing sequences a, b and m
crank star v), firing sequence j
crank star vi), one of the firing sequences c, d and l
crank star vii), firing sequence e
crank star viii), firing sequence f
crank star ix), firing sequence k.

4. The V-type 4-stroke internal combustion engine according to claim 1, having a clockwise direction of rotation, comprising a firing sequence controller that fires cylinders A1 to A10 and B1 to B10 in at least one of the following firing sequences, wherein the direction of rotation and the cylinder numbering is defined in accordance with DIN ISO 1204:

a) B1-B5-A2-B4-A6-A3-B6-A9-A1-B9-A8-A4-B8-A10-B2-B10-A7-B3-B7-A5
b) B1-A4-A2-B4-A6-A3-B6-A9-A1-B9-A8-B5-B8-A10-B2-B10-A7-B3-B7-A5
c) B1-B6-A2-B4-A5-A3-B5-A9-A1-B9-A8-A4-B8-A10-B2-B10-A7-B3-B7-A6
d) B1-A4-A2-B4-A5-A3-B5-A9-A1-B9-A8-B6-B8-A10-B2-B10-A7-B3-B7-A6
e) B1-B9-A5-B3-B5-A4-B2-B4-A1-B6-A7-A3-B7-A10-A2-B10-A8-A6-B8-A9
f) B1-B9-A6-B3-B6-A4-B2-B4-A1-B5-A7-A3-B7-A10-A2-B10-A8-A5-B8-A9
g) B1-B8-A2-B6-A3-B10-A5-B7-A1-B9-A4-A6-B4-A10-B2-A7-B3-A9-B5-A8
h) B1-B8-A2-B7-A3-B10-A4-B6-A1-B9-A5-A7-B5-A10-B2-A6-B3-A9-B4-A8
i) B1-A6-B4-A10-B3-A7-B2-A8-A1-B8-A4-B9-A3-B6-A2-B10-A5-B7-B5-A9
j) B1-A6-B3-A10-B4-A8-B2-B8-A1-B7-A3-B9-A4-B6-A2-B10-A5-A7-B5-A9
k) B1-A7-B5-A10-B3-A6-B2-A8-A1-B8-A5-B9-A3-B7-A2-B10-A4-B6-B4-A9
l) B1-B6-A2-A10-B2-B10-A7-A9-B7-B9-A8-A4-B8-B4-A5-A3-B5-B3-A1-A6
m) B1-B5-A2-A10-B2-B10-A7-A9-B7-B9-A8-A4-B8-B4-A6-A3-B6-B3-A1-A5.

5. The V-type 4-stroke internal combustion engine according to claim 4, wherein the combination of firing sequence and crank star is one of the following:

crank star i), firing sequence h
crank star ii), firing sequence i
crank star iii), firing sequence g
crank star iv), one of the firing sequences a, b and m
crank star v), firing sequence j
crank star vi), one of the firing sequences c, d and l
crank star vii), firing sequence e
crank star viii), firing sequence f
crank star ix), firing sequence k.

6. The V-type 4-stroke internal combustion engine according to claim 1, wherein a V-angle is between 40° and 80°.

7. The V-type 4-stroke internal combustion engine according to claim 6, wherein the V-angle is 60°.

8. The V-type 4-stroke internal combustion engine according to claim 1, wherein the crank throws are arranged on the crank star with an angle of n*36°±5°, and wherein n is a different integer between 1 and 10 for each crank star.

9. The V-type 4-stroke internal combustion engine according to claim 1, wherein the firing sequences have an angular firing distance for a firing of two cylinders of the same bank between 26° and 46°, and/or wherein the firing sequences have, for a counter-clockwise direction of rotation, an angular firing distance for a firing of a cylinder of an A-bank followed by a firing of a cylinder of a B-bank of between 38° and 58°, and/or for a firing of a cylinder of the B-bank followed by a firing of a cylinder of the A-bank of between 14° and 34°, and/or wherein the firing sequences have, for a clockwise direction of rotation, an angular firing distance for a firing of a cylinder of the B-bank followed by a firing of a cylinder of the A-bank of between 38° and 58°, and/or for a firing of a cylinder of the A-bank followed by a firing of a cylinder of the B-bank of between 14° and 34°.

10. The V-type 4-stroke internal combustion engine according to claim 9, wherein the firing sequences have an angular firing distance for the firing of two cylinders of the same bank at 36°, and/or wherein the firing sequences have, for the counter-clockwise direction of rotation, an angular firing distance for the firing of a cylinder of the A-bank followed by a firing of a cylinder of the B-bank at 48° and/or for the firing of a cylinder of the B-bank followed by the firing of a cylinder of the A-bank of 24°, and/or wherein the firing sequences have, for the clockwise direction of rotation, an angular firing distance for the firing of a cylinder of the B-bank followed by the firing of a cylinder of the A-bank of 48°, and/or for the firing of a cylinder of the A-bank followed by the firing of a cylinder of the B-bank of 24°.

11. The V-type 4-stroke internal combustion engine according to claim 1, wherein the crank shaft is made from a self-ageing, micro-alloyed steel, and/or comprising a torsional vibration damper, wherein power dissipation of the torsional vibration damper is preferably below 6 per mil of the maximum engine power, and/or wherein the torsional vibration damper is a viscous damper.

12. The V-type 4-stroke internal combustion engine according to claim 11, wherein the power dissipation of the torsional vibration damper is below 2 per mil of the maximum engine power, and/or wherein the torsional vibration damper is arranged on an opposite side of the crankshaft from the flywheel.

13. The V-type 4-stroke internal combustion engine according to claim 1, wherein a displacement volume per cylinder is between 1 l and 20 l, and/or wherein maximum engine power per liter displacement volume is between 10 kW and 100 kW, and/or wherein the engine has an operating speed range of between 600 and 2100 rpm, and/or wherein the engine has an engine controller programmed to run the engine at a constant nominal operating speed, wherein the constant nominal operating speed is adaptable based on engine conditions and/or load conditions, and/or wherein the constant nominal operating speed is from an operating speed range between 600 and 2100 rpm, and/or wherein the engine is operable with a gaseous and/or with liquid fuels.

14. The V-type 4-stroke internal combustion engine according to claim 13, wherein the displacement volume per cylinder is between 2 l and 9 l, and/or wherein the maximum engine power per liter displacement volume is between 20 kW and 70 kW, and/or wherein the engine is operated with at least one of the following fuels: gas, diesel, or gasoline; and/or wherein the engine has a direct injection system and/or a high pressure injection system, and/or wherein the engine is operated with a Diesel or an Otto combustion method, and/or wherein the engine controller is programmed to operate the engine with a homogeneous charge and/or stratified charge combustion method.

15. The V-type 4-stroke internal combustion engine according to claim 1, wherein the engine is a suction engine or has a charging system having one or several stages, and/or wherein all cylinders of one cylinder bank have a common intake manifold and/or a common exhaust manifold, wherein the exhaust manifolds are arranged with respect to the V-angle on the inside and the intake manifolds are arranged with respect to the V-angle on the outside.

16. The V-type 4-stroke internal combustion engine according to claim 1, wherein the engine is used as a power unit in a heavy duty and/or mining and/or earth moving and/or transport and/or cargo and/or load handling machine, and/or wherein the engine is used to run a generator and/or a hydraulic pump, the generator and/or the hydraulic pump operating one or more drives of an undercarriage and/or working equipment, and/or wherein the engine is coupled directly or via a mechanical gear train to an undercarriage and/or working equipment, and/or wherein the engine is used as the main power unit for a ship and/or a train, and/or wherein the engine is used as a power unit in military equipment and/or for fluid transport and/or for gas and/or fuel production and/or treatment, and/or wherein the engine is used as a power unit for power generation, and/or wherein the engine is used as a power unit for a mobile and/or stationary machine, and/or wherein the engine is coupled torsionally stiffly and/or via a torsionally elastic coupling to the load.

17. A machine comprising a V-type 4-stroke internal combustion engine according to claim 1, wherein the machine is in a heavy duty and/or mining and/or earth moving and/or transport and/or cargo and/or load handling machine, and/or ship and/or train and/or military and/or fluid transport and/or gas and/or oil production and/or treatment machine and/or a power generator.

18. A firing sequence controller or software for a V-type 4-stroke internal combustion engine with 20 cylinders, wherein the engine cylinders are numbered A1 to A10 and B1 to B10, and wherein the direction of rotation and the cylinder numbering is defined in accordance with DIN ISO 1204, the firing sequence controller or software implementing at least one of the firing sequences, wherein the engine having a counter-clockwise direction of rotation:

a) A1-A5-B2-A4-B6-B3-A6-B9-B1-A9-B8-B4-A8-B10-A2-A10-B7-A3-A7-B5
b) A1-B4-B2-A4-B6-B3-A6-B9-B1-A9-B8-A5-A8-B10-A2-A10-B7-A3-A7-B5
c) A1-A6-B2-A4-B5-B3-A5-B9-B1-A9-B8-B4-A8-B10-A2-A10-B7-A3-A7-B6
d) A1-B4-B2-A4-B5-B3-A5-B9-B1-A9-B8-A6-A8-B10-A2-A10-B7-A3-A7-B6
e) A1-A9-B5-A3-A5-B4-A2-A4-B1-A6-B7-B3-A7-B10-B2-A10-B8-B6-A8-B9
f) A1-A9-B6-A3-A6-B4-A2-A4-B1-A5-B7-B3-A7-B10-B2-A10-B8-B5-A8-B9
g) A1-A8-B2-A6-B3-A10-B5-A7-B1-A9-B4-B6-A4-B10-A2-B7-A3-B9-A5-B8
h) A1-A8-B2-A7-B3-A10-B4-A6-B1-A9-B5-B7-A5-B10-A2-B6-A3-B9-A4-B8
i) A1-B6-A4-B10-A3-B7-A2-B8-B1-A8-B4-A9-B3-A6-B2-A10-B5-A7-A5-B9
j) A1-B6-A3-B10-A4-B8-A2-A8-B1-A7-B3-A9-B4-A6-B2-A10-B5-B7-A5-B9
k) A1-B7-A5-B10-A3-B6-A2-B8-B1-A8-B5-A9-B3-A7-B2-A10-B4-A6-A4-B9
l) A1-A6-B2-B10-A2-A10-B7-B9-A7-A9-B8-B4-A8-A4-B5-B3-A5-A3-B1-B6 m) A1-A5-B2-B10-A2-A10-B7-B9-A7-A9-B8-B4-A8-A4-B6-B3-A6-A3-B1-B5, or, wherein the engine having a clockwise direction of rotation:

a) B1-B5-A2-B4-A6-A3-B6-A9-A1-B9-A8-A4-B8-A10-B2-B10-A7-B3-B7-A5 b) B1-A4-A2-B4-A6-A3-B6-A9-A1-B9-A8-B5-B8-A10-B2-B10-A7-B3-B7-A5 c) B1-B6-A2-B4-A5-A3-B5-A9-A1-B9-A8-A4-B8-A10-B2-B10-A7-B3-B7-A6 d) B1-A4-A2-B4-A5-A3-B5-A9-A1-B9-A8-B6-B8-A10-B2-B10-A7-B3-B7-A6 e) B1-B9-A5-B3-B5-A4-B2-B4-A1-B6-A7-A3-B7-A10-A2-B10-A8-A6-B8-A9 f) B1-B9-A6-B3-B6-A4-B2-B4-A1-B5-A7-A3-B7-A10-A2-B10-A8-A5-B8-A9 g) B1-B8-A2-B6-A3-B10-A5-B7-A1-B9-A4-A6-B4-A10-B2-A7-B3-A9-B5-A8 h) B1-B8-A2-B7-A3-B10-A4-B6-A1-B9-A5-A7-B5-A10-B2-A6-B3-A9-B4-A8 i) B1-A6-B4-A10-B3-A7-B2-A8-A1-B8-A4-B9-A3-B6-A2-B10-A5-B7-B5-A9 j) B1-A6-B3-A10-B4-A8-B2-B8-A1-B7-A3-B9-A4-B6-A2-B10-A5-A7-B5-A9 k) B1-A7-B5-A10-B3-A6-B2-A8-A1-B8-A5-B9-A3-B7-A2-B10-A4-B6-B4-A9 l) B1-B6-A2-A10-B2-B10-A7-A9-B7-B9-A8-A4-B8-B4-A5-A3-B5-B3-A1-A6 m) B1-B5-A2-A10-B2-B10-A7-A9-B7-B9-A8-A4-B8-B4-A6-A3-B6-B3-A1-A5.

19. A method for operating a V-type 4-stroke internal combustion engine with 20 cylinders, wherein the engine cylinders are numbered A1 to A10 and B1 to B10, wherein the direction of rotation and the cylinder numbering is defined in accordance with DIN ISO 1204, wherein the engine is operated with at least one of the firing sequences, wherein the engine is operated in a counter-clockwise direction of rotation:

a) A1-A5-B2-A4-B6-B3-A6-B9-B1-A9-B8-B4-A8-B10-A2-A10-B7-A3-A7-B5 b) A1-B4-B2-A4-B6-B3-A6-B9-B1-A9-B8-A5-A8-B10-A2-A10-B7-A3-A7-B5 c) A1-A6-B2-A4-B5-B3-A5-B9-B1-A9-B8-B4-A8-B10-A2-A10-B7-A3-A7-B6 d) A1-B4-B2-A4-B5-B3-A5-B9-B1-A9-B8-A6-A8-B10-A2-A10-B7-A3-A7-B6 e) A1-A9-B5-A3-A5-B4-A2-A4-B1-A6-B7-B3-A7-B10-B2-A10-B8-B6-A8-B9 f) A1-A9-B6-A3-A6-B4-A2-A4-B1-A5-B7-B3-A7-B10-B2-A10-B8-B5-A8-B9 g) A1-A8-B2-A6-B3-A10-B5-A7-B1-A9-B4-B6-A4-B10-A2-B7-A3-B9-A5-B8 h) A1-A8-B2-A7-B3-A10-B4-A6-B1-A9-B5-B7-A5-B10-A2-B6-A3-B9-A4-B8 i) A1-B6-A4-B10-A3-B7-A2-B8-B1-A8-B4-A9-B3-A6-B2-A10-B5-A7-A5-B9 j) A1-B6-A3-B10-A4-B8-A2-A8-B1-A7-B3-A9-B4-A6-B2-A10-B5-B7-A5-B9 k) A1-B7-A5-B10-A3-B6-A2-B8-B1-A8-B5-A9-B3-A7-B2-A10-B4-A6-A4-B9 l) A1-A6-B2-B10-A2-A10-B7-B9-A7-A9-B8-B4-A8-A4-B5-B3-A5-A3-B1-B6 m) A1-A5-B2-B10-A2-A10-B7-B9-A7-A9-B8-B4-A8-A4-B6-B3-A6-A3-B1-B5, or, wherein the engine is operated in a clockwise direction of rotation:

a) B1-B5-A2-B4-A6-A3-B6-A9-A1-B9-A8-A4-B8-A10-B2-B10-A7-B3-B7-A5 b) B1-A4-A2-B4-A6-A3-B6-A9-A1-B9-A8-B5-B8-A10-B2-B10-A7-B3-B7-A5 c) B1-B6-A2-B4-A5-A3-B5-A9-A1-B9-A8-A4-B8-A10-B2-B10-A7-B3-B7-A6 d) B1-A4-A2-B4-A5-A3-B5-A9-A1-B9-A8-B6-B8-A10-B2-B10-A7-B3-B7-A6 e) B1-B9-A5-B3-B5-A4-B2-B4-A1-B6-A7-A3-B7-A10-A2-B10-A8-A6-B8-A9 f) B1-B9-A6-B3-B6-A4-B2-B4-A1-B5-A7-A3-B7-A10-A2-B10-A8-A5-B8-A9 g) B1-B8-A2-B6-A3-B10-A5-B7-A1-B9-A4-A6-B4-A10-B2-A7-B3-A9-B5-A8 h) B1-B8-A2-B7-A3-B10-A4-B6-A1-B9-A5-A7-B5-A10-B2-A6-B3-A9-B4-A8 i) B1-A6-B4-A10-B3-A7-B2-A8-A1-B8-A4-B9-A3-B6-A2-B10-A5-B7-B5-A9 j) B1-A6-B3-A10-B4-A8-B2-B8-A1-B7-A3-B9-A4-B6-A2-B10-A5-A7-B5-A9 k) B1-A7-B5-A10-B3-A6-B2-A8-A1-B8-A5-B9-A3-B7-A2-B10-A4-B6-B4-A9 l) B1-B6-A2-A10-B2-B10-A7-A9-B7-B9-A8-A4-B8-B4-A5-A3-B5-B3-A1-A6 m) B1-B5-A2-A10-B2-B10-A7-A9-B7-B9-A8-A4-B8-B4-A6-A3-B6-B3-A1.

* * * * *